US011998151B2

(12) United States Patent
Goddard et al.

(10) Patent No.: US 11,998,151 B2
(45) Date of Patent: Jun. 4, 2024

(54) CLEANING ROLLER FOR CLEANING ROBOTS

(71) Applicant: iRobot Corporation, Bedford, MA (US)

(72) Inventors: William Goddard, Somerville, MA (US); Matthew Blouin, Townsend, MA (US)

(73) Assignee: iRobot Corporation, Bedford, MA (US)

( * ) Notice: Subject to any disclaimer, the term of this patent is extended or adjusted under 35 U.S.C. 154(b) by 39 days.

(21) Appl. No.: 17/705,895

(22) Filed: Mar. 28, 2022

(65) Prior Publication Data

US 2022/0218171 A1 Jul. 14, 2022

Related U.S. Application Data

(63) Continuation of application No. 16/725,107, filed on Dec. 23, 2019, now Pat. No. 11,284,769, which is a (Continued)

(51) Int. Cl.

| | |
|---|---|
| ***A47L 11/40*** | (2006.01) |
| ***A47L 9/04*** | (2006.01) |
| ***A47L 11/24*** | (2006.01) |

(52) U.S. Cl.

CPC ..... *A47L 11/4041* (2013.01); *A47L 9/0477* (2013.01); *A47L 11/24* (2013.01); (Continued)

(58) Field of Classification Search

CPC ..... A47L 9/0477; A47L 11/24; A47L 11/32; A47L 11/33; A47L 11/4013; A47L 11/4041; A47L 2201/00

See application file for complete search history.

(56) References Cited

U.S. PATENT DOCUMENTS 1,829,548 A 10/1931 Smellie et al.
1,919,067 A 7/1933 Lang et al.
(Continued)

FOREIGN PATENT DOCUMENTS

CN 101874721 11/2010
CN 103491839 A * 1/2014
(Continued)

OTHER PUBLICATIONS

EP Extended European Search Report in EP Appln. No. 16900773.9, dated Nov. 5, 2020, 7 pages.
(Continued)

*Primary Examiner* — Randall E Chin
(74) *Attorney, Agent, or Firm* — Fish & Richardson P.C.

(57) ABSTRACT

A cleaning roller mountable to a cleaning robot includes an elongate shaft extending from a first end portion to a second end portion along an axis of rotation. The first and second end portions are mountable to the cleaning robot for rotating about the axis of rotation. The cleaning roller further includes a core affixed around the shaft and having outer end portions positioned along the elongate shaft and proximate the first and second end portions. The core tapers from proximate the first end portion of the shaft toward a center of the shaft. The cleaning roller further includes a sheath affixed to the core and extending beyond the outer end portions of the core. The sheath includes a first half and a second half each tapering toward the center of the shaft.

22 Claims, 12 Drawing Sheets

Related U.S. Application Data continuation of application No. 15/380,530, filed on Dec. 15, 2016, now Pat. No. 10,512,384.

(52) U.S. Cl.
CPC ..... *A47L 11/4013* (2013.01); *A47L 11/4044* (2013.01); *A47L 2201/00* (2013.01)

(56) References Cited

U.S. PATENT DOCUMENTS

| | | | |
|---|---|---|---|
| 2,064,856 | A | 12/1936 | Riebel |
| 2,298,682 | A | 10/1942 | Dahlstom et al. |
| 2,578,549 | A | 12/1951 | Hooban |
| 2,770,825 | A | 11/1956 | Kuroki et al. |
| 2,881,461 | A | 4/1959 | Parker et al. |
| 4,222,146 | A | 9/1980 | Hertzberg |
| 4,401,909 | A | 8/1983 | Gorsek |
| 4,552,505 | A | 11/1985 | Gorman |
| 4,679,152 | A | 7/1987 | Perdue |
| 4,908,898 | A | 3/1990 | Kubo |
| 4,918,441 | A | 4/1990 | Bohman |
| 4,962,453 | A | 10/1990 | Pong et al. |
| 5,056,181 | A | 10/1991 | Tsuchiya et al. |
| 5,086,535 | A | 2/1992 | Grossmeyer et al. |
| 5,109,566 | A | 5/1992 | Kobayashi et al. |
| 5,204,814 | A | 4/1993 | Noonan et al. |
| 5,216,777 | A | 6/1993 | Moro et al. |
| 5,233,682 | A | 8/1993 | Abe et al. |
| 5,251,358 | A | 10/1993 | Moro et al. |
| 5,284,522 | A | 2/1994 | Kobayashi et al. |
| 5,321,614 | A | 6/1994 | Ashworth |
| 5,341,540 | A | 8/1994 | Soupert et al. |
| 5,365,634 | A | 11/1994 | Hughes |
| 5,410,479 | A | 4/1995 | Coker |
| 5,495,634 | A | 3/1996 | Brundula et al. |
| 5,507,067 | A | 4/1996 | Hoeskstra et al. |
| 5,515,572 | A | 5/1996 | Hoeskstra et al. |
| 5,536,953 | A | 7/1996 | Kurz |
| 5,542,146 | A | 8/1996 | Hoekstra et al. |
| 5,548,511 | A | 8/1996 | Bancroft |
| 5,613,261 | A | 3/1997 | Kawakami et al. |
| 5,646,494 | A | 7/1997 | Han |
| 5,682,313 | A | 10/1997 | Edlund et al. |
| 5,710,506 | A | 1/1998 | Broell et al. |
| 5,813,086 | A | 9/1998 | Ueno et al. |
| 5,815,884 | A | 10/1998 | Imamura et al. |
| 5,867,800 | A | 2/1999 | Leif |
| 5,910,700 | A | 6/1999 | Crotzer |
| 5,935,179 | A | 8/1999 | Kleiner et al. |
| 5,942,869 | A | 8/1999 | Katou et al. |
| 5,959,423 | A | 9/1999 | Nakanishi et al. |
| 6,055,702 | A | 5/2000 | Imamura et al. |
| 6,076,025 | A | 6/2000 | Ueno et al. |
| 6,076,227 | A | 6/2000 | Schallig et al. |
| 6,091,219 | A | 7/2000 | Maruo et al. |
| 6,212,732 | B1 | 4/2001 | Tajima et al. |
| 6,220,865 | B1 | 4/2001 | Macri et al. |
| 6,278,918 | B1 | 8/2001 | Dickson et al. |
| 6,285,930 | B1 | 9/2001 | Dickson et al. |
| 6,321,337 | B1 | 11/2001 | Reshef et al. |
| 6,323,570 | B1 | 11/2001 | Nishimura et al. |
| 6,370,453 | B2 | 4/2002 | Sommer |
| 6,385,515 | B1 | 5/2002 | Dickson et al. |
| 6,389,329 | B1 | 5/2002 | Colens |
| 6,400,048 | B1 | 6/2002 | Nishimura et al. |
| 6,437,465 | B1 | 8/2002 | Nishimura et al. |
| 6,459,955 | B1 | 10/2002 | Bartsch et al. |
| 6,463,368 | B1 | 10/2002 | Feiten et al. |
| 6,470,237 | B2 | 10/2002 | Fujita et al. |
| 6,490,539 | B1 | 12/2002 | Dickson et al. |
| 6,505,341 | B1 | 1/2003 | Harris et al. |
| 6,556,892 | B2 | 4/2003 | Kuroki et al. |
| 6,574,536 | B1 | 6/2003 | Kawagoe et al. |
| 6,584,376 | B1 | 6/2003 | Van Kommer |
| 6,671,592 | B1 | 12/2003 | Bisset et al. |
| 6,690,134 | B1 | 2/2004 | Jones et al. |
| 6,742,220 | B2 | 6/2004 | Nagai et al. |
| 6,781,338 | B2 | 8/2004 | Jones et al. |
| 6,809,490 | B2 | 10/2004 | Jones et al. |
| 6,845,297 | B2 | 1/2005 | Allard |
| 6,883,201 | B2 | 4/2005 | Jones et al. |
| 7,027,893 | B2 | 4/2006 | Perry et al. |
| 7,085,623 | B2 | 8/2006 | Sigers |
| 7,147,238 | B2 | 12/2006 | Oi |
| 7,159,276 | B2 | 1/2007 | Omoto et al. |
| 7,171,723 | B2 | 2/2007 | Kobayashi et al. |
| 7,193,384 | B1 | 3/2007 | Norman et al. |
| 7,228,202 | B2 | 6/2007 | Carlson et al. |
| 7,283,892 | B1 | 10/2007 | Boillot et al. |
| 7,363,108 | B2 | 4/2008 | Noda et al. |
| 7,424,611 | B2 | 9/2008 | Hino et al. |
| D647,265 | S | 10/2011 | Follows et al. |
| 8,316,503 | B2 | 11/2012 | Follows et al. |
| 8,881,339 | B2 | 11/2014 | Gilbert, Jr. et al. |
| 8,910,342 | B2 | 12/2014 | Gilbert, Jr. et al. |
| 8,955,192 | B2 | 2/2015 | Gilbert, Jr. et al. |
| D728,877 | S | 5/2015 | Therrien |
| 9,173,534 | B2 | 11/2015 | Ando et al. |
| 9,220,386 | B2 | 12/2015 | Gilbert, Jr. et al. |
| 9,320,400 | B2 | 4/2016 | Gilbert, Jr. et al. |
| 9,326,654 | B2 | 5/2016 | Doughty |
| 9,351,619 | B2 | 5/2016 | Bosses |
| D774,263 | S | 12/2016 | Reichel et al. |
| 10,512,384 | B2 | 12/2019 | Goddard et al. |
| 11,284,769 | B2 | 3/2022 | Goddard et al. |
| 2002/0081937 | A1 | 6/2002 | Yamada et al. |
| 2002/0169521 | A1 | 11/2002 | Goodman et al. |
| 2003/0159240 | A1 | 8/2003 | Mertes et al. |
| 2004/0020000 | A1 | 2/2004 | Jones |
| 2004/0045125 | A1 | 3/2004 | Park et al. |
| 2004/0049877 | A1 | 3/2004 | Jones et al. |
| 2004/0074028 | A1 | 4/2004 | Goff |
| 2004/0098167 | A1 | 5/2004 | Yi et al. |
| 2004/0187249 | A1 | 9/2004 | Jones et al. |
| 2004/0204792 | A1 | 10/2004 | Taylor et al. |
| 2004/0211444 | A1 | 10/2004 | Taylor et al. |
| 2004/0216265 | A1 | 11/2004 | Peacock et al. |
| 2004/0236468 | A1 | 11/2004 | Taylor et al. |
| 2004/0244138 | A1 | 12/2004 | Taylor et al. |
| 2005/0181968 | A1 | 8/2005 | Policicchio et al. |
| 2005/0183229 | A1 | 8/2005 | Uehigashi |
| 2005/0204717 | A1 | 9/2005 | Colens |
| 2007/0095367 | A1 | 5/2007 | Wang et al. |
| 2008/0052846 | A1 | 3/2008 | Kapoor et al. |
| 2010/0037418 | A1 | 2/2010 | Hussey et al. |
| 2010/0287717 | A1 | 11/2010 | Jang et al. |
| 2013/0232702 | A1 | 9/2013 | Baek et al. |
| 2014/0259475 | A1 | 9/2014 | Doughty |
| 2015/0335220 | A1 | 11/2015 | Kim et al. |
| 2016/0103451 | A1* | 4/2016 | Vicenti ..... A47L 11/4066 700/259 |
| 2016/0166127 | A1 | 6/2016 | Lewis |
| 2016/0235270 | A1 | 8/2016 | Santini |
| 2018/0168417 | A1 | 6/2018 | Goddard et al. |
| 2019/0104900 | A1 | 4/2019 | Ll et al. |
| 2020/0129030 | A1 | 4/2020 | Goddard et al. |

FOREIGN PATENT DOCUMENTS

| | | |
|---|---|---|
| CN | 203898204 | 10/2014 |
| CN | 105686758 | 6/2016 |
| CN | 205514379 | 8/2016 |
| CN | 207444902 | 6/2018 |
| DE | 4400956 | 10/1994 |
| EP | 0051996 | 5/1982 |
| EP | 1228734 | 8/2002 |
| GB | 2262433 | 6/1993 |
| GB | 2344863 | 6/2000 |
| GB | 2446817 | 8/2008 |
| GB | 157616 | 1/2021 |
| JP | S55-146044 | 4/1980 |
| JP | 55104929 | 4/1982 |
| JP | S58455 | 1/1983 |
| JP | S 62-292127 | 12/1987 |

(56) References Cited

FOREIGN PATENT DOCUMENTS

| | | |
|---|---|---|
| JP | 63-105730 | 5/1988 |
| JP | 05049566 | 3/1993 |
| JP | 5-285075 | 11/1993 |
| JP | 06007271 | 1/1994 |
| JP | 06014853 | 1/1994 |
| JP | H6-046652 | 6/1994 |
| JP | 08173355 | 7/1996 |
| JP | H11216084 | 8/1999 |
| JP | 2000-157462 | 6/2000 |
| JP | 2000354567 | 12/2000 |
| JP | 2002112931 | 4/2002 |
| JP | 2002345698 | 12/2002 |
| JP | 2003000484 | 1/2003 |
| JP | 2003290092 | 10/2003 |
| JP | 2003290093 | 10/2003 |
| JP | 2004121795 | 4/2004 |
| JP | 2006034996 | 2/2006 |
| JP | 2006149455 | 6/2006 |
| JP | 2006325761 | 12/2006 |
| JP | 05146382 | 1/2008 |
| JP | 2008000382 | 1/2008 |
| JP | 2009017902 | 1/2009 |
| JP | 2010-110344 | 5/2010 |
| JP | 2011016001 | 1/2011 |
| JP | 2011115541 | 6/2011 |
| JP | 2015-163254 | 9/2015 |
| KR | 10-2007- 0016420 | 2/2007 |
| KR | 20110125942 | 11/2011 |
| WO | WO 1995/016382 | 6/1995 |
| WO | WO 2005/107563 | 11/2005 |
| WO | WO 2007/065033 | 6/2007 |
| WO | WO 2009/117383 | 9/2009 |
| WO | WO 2009/149722 | 12/2009 |
| WO | WO 2011/121816 | 10/2011 |

OTHER PUBLICATIONS

Extended European Search Report and Written Opinion in EP Appln. No. 17200982, dated Jan. 17, 2020, 6 pages.

PCT International Preliminary Report in International Appln. No. PCT/US2016/066942, dated Jun. 18, 2019, 7 pages.

PCT International Search Report in International Application No. PCT/US2016/066942, dated Jul. 7, 2017, 10 pages.

* cited by examiner

CLEANING ROLLER FOR CLEANING ROBOTS

CROSS-REFERENCE TO RELATED APPLICATIONS

This application is a continuation of and claims priority to U.S. application Ser. No. 16/725,107, now U.S. Pat. No. 11,284,769, filed on Dec. 23, 2019, which is a continuation of and claims priority to U.S. application Ser. No. 15/380,530, now U.S. Pat. No. 10,512,384, filed on Dec. 15, 2016, the entire contents of which are hereby incorporated by reference.

TECHNICAL FIELD

This specification relates to cleaning rollers, in particular, for cleaning robots.

BACKGROUND

An autonomous cleaning robot can navigate across a floor surface and avoid obstacles while vacuuming the floor surface to ingest debris from the floor surface. The cleaning robot can include rollers to pick up the debris from the floor surface. As the cleaning robot moves across the floor surface, the robot can rotate the rollers, which guide the debris toward a vacuum airflow generated by the cleaning robot. In this regard, the rollers and the vacuum airflow can cooperate to allow the robot to ingest debris. During its rotation, the roller can engage debris that includes hair and other filaments. The filament debris can become wrapped around the rollers.

SUMMARY

In one aspect, a cleaning roller mountable to a cleaning robot includes an elongate shaft extending from a first end portion to a second end portion along an axis of rotation. The first and second end portions are mountable to the cleaning robot for rotating about the axis of rotation. The cleaning roller further includes a core affixed around the shaft and having outer end portions positioned along the elongate shaft and proximate the first and second end portions. The core tapers from proximate the first end portion of the shaft toward a center of the shaft and tapers from proximate the second end portion of the shaft toward the center of the shaft. The cleaning roller further includes a sheath affixed to the core and extending beyond the outer end portions of the core. The sheath includes a first half and a second half each tapering toward the center of the shaft. The cleaning roller further includes collection wells defined by the outer end portions of the core and the sheath.

In another aspect, an autonomous cleaning robot includes a body, a drive operable to move the body across a floor surface, and a cleaning assembly. The cleaning assembly includes a roller. The roller is, for example, a first cleaning roller mounted to the body and rotatable about a first axis, and the cleaning assembly further includes a second cleaning roller mounted to the body and rotatable about a second axis parallel to the first axis. A shell of the first cleaning roller and the second cleaning roller define a separation therebetween, the separation extending along the first axis and increasing toward a center of a length of the first cleaning roller.

In some implementations, a length of the cleaning roller is between 20 cm and 30 cm. The sheath is, for example, affixed to the elongate shaft along 75% to 90% of a length of the sheath.

In some implementations, the elongate shaft is configured to be driven by a motor of the cleaning robot.

In some implementations, the core includes a plurality of discontinuous sections positioned around the shaft and within the sheath. In some cases, the sheath is fixed to the core between the discontinuous sections. In some cases, the sheath is bonded to the shaft at a location between the discontinuous sections of the core.

In some implementations, the core includes a plurality of posts extending away from the axis of rotation toward the sheath. The posts engage the sheath to couple the sheath to the core.

In some implementations, a minimum diameter of the core is at the center of the shaft.

In some implementations, each of the first half and the second half of the sheath includes an outer surface. The outer surface, for example, forms an angle between 5 and 20 degrees with the axis of rotation.

In some implementations, the first half of the sheath tapers from proximate the first end portion to the center of the shaft, and the second half of the sheath tapers from proximate the second end portion of the shaft toward the center of the shaft.

In some implementations, the sheath includes a shell surrounding and affixed to the core. The shell includes frustoconical halves.

In some implementations, the sheath includes a shell surrounding and affixed to the core. The sheath includes, for example, a vane extending radially outwardly from the shell. A height of the vane proximate the first end portion of the shaft is, for example, less than a height of the vane proximate the center of the shaft. In some cases, the vane follows a V-shaped path along an outer surface of the sheath. In some cases, the height of the vane proximate the first end portion is between 1 and 5 millimeters, and the height of the vane proximate the center of the shaft is between 10 and 30 millimeters.

In some implementations, a length of one of the collection wells is 5% to 15% of the length of the cleaning roller.

In some implementations, tubular portions of the sheath define the collection wells.

In some implementations, the sheath further includes a shell surrounding and affixed to the core, a maximum width of the shell being 80% and 95% of an overall diameter of the sheath.

In some implementations, the shell of the first cleaning roller and a shell of the second cleaning roller define the separation.

In some implementations, the separation is between 5 and 30 millimeters at the center of the length of the first cleaning roller.

In some implementations, the length of the first cleaning roller is between 20 and 30 centimeters. In some cases, the length of the first cleaning roller is greater than a length of the second cleaning roller. In some cases, the length of the first cleaning roller is equal to a length of the second cleaning roller.

In some implementations, a forward portion of the body has a substantially rectangular shape. The first and second cleaning rollers are, for example, mounted to an underside of the forward portion of the body.

In some implementations, the first cleaning roller and the second cleaning roller define an air gap therebetween at the center of the length of the first cleaning roller. The air gap, for example, varies in width as the first cleaning roller and the second cleaning roller are rotated.

Advantages of the foregoing may include, but are not limited to, those described below and herein elsewhere. The cleaning roller can improve pickup of debris from a floor surface. Torque can be more easily transferred from a drive shaft to an outer surface of the cleaning roller along an entire length of the cleaning roller. The improve torque transfer enables the outer surface of the cleaning roller to more easily move the debris upon engaging the debris. Compared to other cleaning rollers that do not have the features described herein that enable improved torque transfer, the cleaning roller can pick up more debris when driven with a given amount of torque.

The cleaning roller can have an increased length without reducing the ability of the cleaning roller to pick up debris from the floor surface. In particular, the cleaning roller, when longer, can require a greater amount of drive torque. However, because of the improved torque transfer of the cleaning roller, a smaller amount of torque can be used to drive the cleaning roller to achieve debris pickup capability similar to the debris pickup capability of other cleaning rollers. If the cleaning roller is mounted to a cleaning robot, the cleaning roller can have a length that extends closer to lateral sides of the cleaning robot so that the cleaning roller can reach debris over a larger range.

In other examples, the cleaning roller can be configured to collect filament debris in a manner that does not impede the cleaning performance of the cleaning roller. The filament debris, when collected, can be easily removable. In particular, as the cleaning roller engages with filament debris from a floor surface, the cleaning roller can cause the filament debris to be guided toward outer ends of the cleaning roller where collection wells for filament debris are located. The collection wells can be easily accessible to the user when the rollers are dismounted from the robot so that the user can easily dispose of the filament debris. In addition to preventing damage to the cleaning roller, the improved collection of filament debris can reduce the likelihood that filament debris will impede the debris pickup ability of the cleaning roller, e.g., by wrapping around the outer surface of the cleaning roller.

In further examples, the cleaning roller can cooperate with another cleaning roller to define a separation therebetween that improves characteristics of airflow generated by a vacuum assembly. The separation, by being larger toward a center of the cleaning rollers, can concentrate the airflow toward the center of the cleaning rollers. While filament debris can tend to collect toward the ends of the cleaning rollers, other debris can be more easily ingested through the center of the cleaning rollers where the airflow rate is highest.

The details of one or more implementations of the subject matter described in this specification are set forth in the accompanying drawings and the description below. Other potential features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
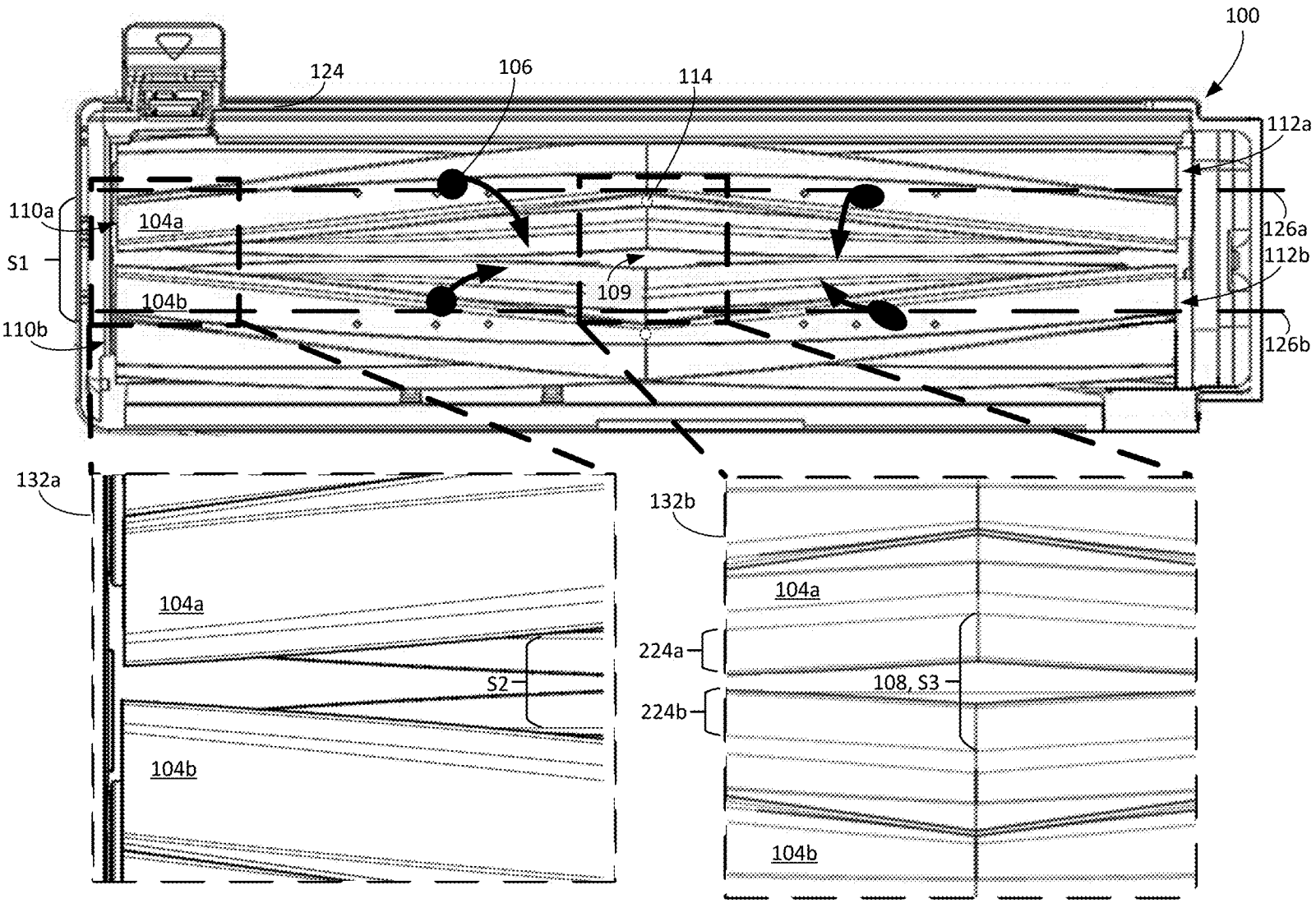
FIG. 1A is a bottom view of a cleaning head during a cleaning operation of a cleaning robot.
Figure 1B:
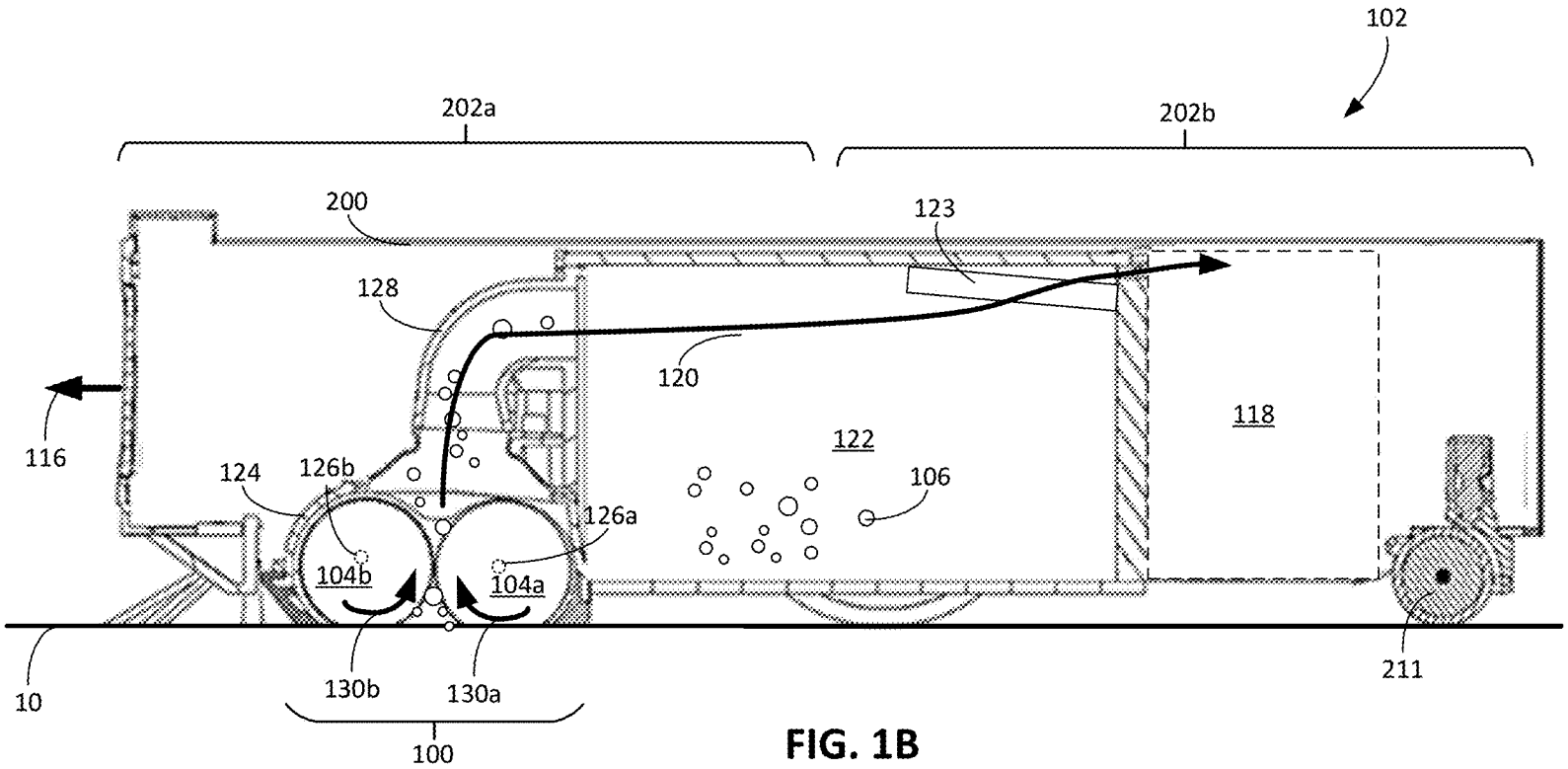
FIG. 1B is a cross-sectional side view of a cleaning robot and the cleaning head of FIG. 1A during the cleaning operation.

Referring to FIGS. 1A and 1B, a cleaning head 100 for a cleaning robot 102 includes cleaning rollers 104*a*, 104*b* that are positioned to engage debris 106 on a floor surface 10. FIG. 1A depicts the cleaning head 100 during a cleaning operation, with the cleaning head 100 isolated from the cleaning robot 102 to which the cleaning head 100 is mounted. The cleaning robot 102 moves about the floor surface 10 while ingesting the debris 106 from the floor surface 10. FIG. 1B depicts the cleaning robot 102, with the cleaning head 100 mounted to the cleaning robot 102, as the cleaning robot 102 traverses the floor surface 10 and rotates the rollers 104*a*, 104*b* to ingest the debris 106 from the floor surface 10 during the cleaning operation. During the cleaning operation, the cleaning rollers 104*a*, 104*b* are rotatable to lift the debris 106 from the floor surface 10 into the cleaning robot 102. Outer surfaces of the cleaning rollers 104*a*, 104*b* engage the debris 106 and agitate the debris 106. The rotation of the cleaning rollers 104*a*, 104*b* facilitates movement of the debris 106 toward an interior of the cleaning robot 102.

In some implementations, as described herein, the cleaning rollers 104*a*, 104*b* are elastomeric rollers featuring a pattern of chevron-shaped vanes 224*a*, 224*b* (shown in FIG. 1A) distributed along an exterior surface of the cleaning rollers 104*a*, 104*b*. The vanes 224*a*, 224*b* of at least one of the cleaning rollers 104*a*, 104, e.g., the cleaning roller 104*a*, make contact with the floor surface 10 along the length of the cleaning rollers 104*a*, 104*b* and experience a consistently applied friction force during rotation that is not present with brushes having pliable bristles. Furthermore, like cleaning rollers having distinct bristles extending radially from a shaft, the cleaning rollers 104*a*, 104*b* have vanes 224*a*, 224*b* that extend radially outward. The vanes 224*a*, 224*b*, however, also extend continuously along the outer surface of the cleaning rollers 104*a*, 104*b* in longitudinal directions. The vanes 224*a*, 224*b* also extend along circumferential directions along the outer surface of the cleaning rollers 104*a*, 104*b*, thereby defining V-shaped paths along the outer surface of the cleaning rollers 104*a*, 104*b* as described herein. Other suitable configurations, however, are also contemplated. For example, in some implementations, at least one of the rear and front rollers 104*a*, 104*b* may include bristles and/or elongated pliable flaps for agitating the floor surface in addition or as an alternative to the vanes 224*a*, 224*b*.

As shown in FIG. 1A, a separation 108 and an air gap 109 are defined between the cleaning roller 104*a* and the cleaning roller 104*b*. The separation 108 and the air gap 109 both extend from a first outer end portion 110*a* of the cleaning roller 104*a* to a second outer end portion 112*a* of the cleaning roller 104*a*. As described herein, the separation 108 corresponds to a distance between the cleaning rollers 104*a*, 104*b* absent the vanes on the cleaning rollers 104*a*, 104*b*, while the air gap 109 corresponds to the distance between the cleaning rollers 104*a*, 104*b* including the vanes on the cleaning rollers 104*a*, 104*b*. The air gap 109 is sized to accommodate debris 106 moved by the rollers 104*a*, 104*b* as the rollers 104*a*, 104*b* rotate and to enable airflow to be drawn into the cleaning robot 102 and change in width as the cleaning rollers 104*a*, 104*b* rotate. While the air gap 109 can vary in width during rotation of the rollers 104*a*, 104*b*, the separation 108 has a constant width during rotation of the rollers 104*a*, 104*b*. The separation 108 facilitates movement of the debris 106 caused by the rollers 104*a*, 104*b* upward toward the interior of the robot 102 so that the debris can be ingested by the robot 102. As described herein, the separation 108 increases in size toward a center 114 of a length L1 of the cleaning roller 104*a*, e.g., a center of the cleaning roller 104*a* along a longitudinal axis 126*a* of the cleaning roller 114*a*. The separation 108 decreases in width toward the end portions 110*a*, 112*a* of the cleaning roller 104*a*. Such a configuration of the separation 108 can improve debris pickup capabilities of the rollers 104*a*, 104*b* while reducing likelihood that filament debris picked up by the rollers 104*a*, 104*b* impedes operations of the rollers 104*a*, 104*b*.

Example Cleaning Robots

Figure 2A:
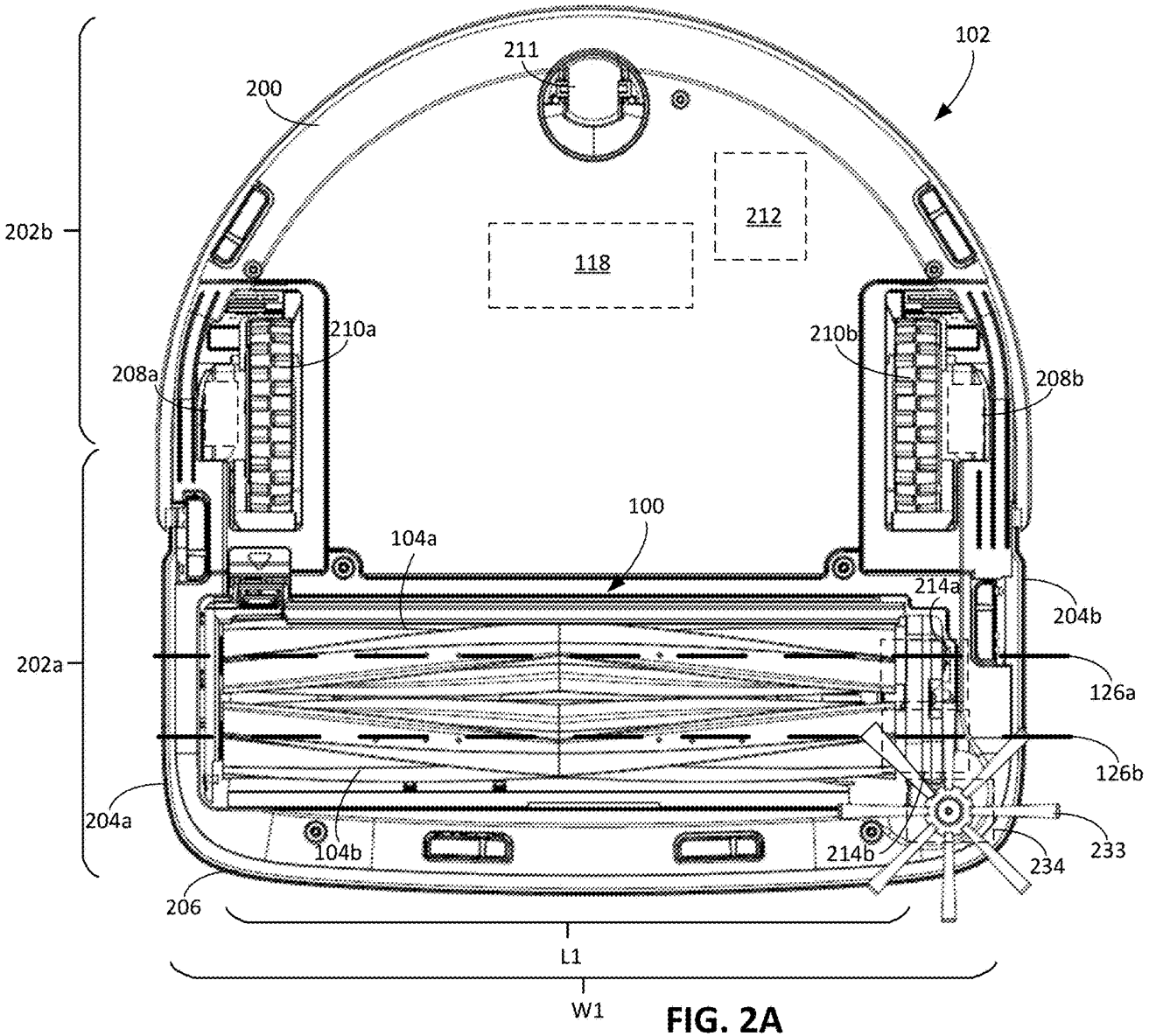
FIG. 2A is a bottom view of the cleaning robot of FIG. 1B.

The cleaning robot 102 is an autonomous cleaning robot that autonomously traverses the floor surface 10 while ingesting the debris 106 from different parts of the floor surface 10. In the example depicted in FIGS. 1B and 2A, the robot 102 includes a body 200 movable across the floor surface 10. The body 200 includes, in some cases, multiple connected structures to which movable components of the cleaning robot 102 are mounted. The connected structures include, for example, an outer housing to cover internal components of the cleaning robot 102, a chassis to which drive wheels 210*a*, 210*b* and the rollers 104*a*, 104*b* are mounted, a bumper mounted to the outer housing, etc. As shown in FIG. 2A, in some implementations, the body 200 includes a front portion 202*a* that has a substantially rectangular shape and a rear portion 202*b* that has a substantially semicircular shape. The front portion 202*a* is, for example, a front one-third to front one-half of the cleaning robot 102, and the rear portion 202*b* is a rear one-half to two-thirds of the cleaning robot 102. The front portion 202*a* includes, for example, two lateral sides 204*a*, 204*b* that are substantially perpendicular to a front side 206 of the front portion 202*a*.

As shown in FIG. 2A, the robot 102 includes a drive system including actuators 208*a*, 208*b*, e.g., motors, operable with drive wheels 210*a*, 210*b*. The actuators 208*a*, 208*b* are mounted in the body 200 and are operably connected to the drive wheels 210*a*, 210*b*, which are rotatably mounted to the body 200. The drive wheels 210*a*, 210*b* support the body 200 above the floor surface 10. The actuators 208*a*, 208*b*, when driven, rotate the drive wheels 210*a*, 210*b* to enable the robot 102 to autonomously move across the floor surface 10.

The robot 102 includes a controller 212 that operates the actuators 208*a*, 208*b* to autonomously navigate the robot 102 about the floor surface 10 during a cleaning operation. The actuators 208*a*, 208*b* are operable to drive the robot 102 in a forward drive direction 116 (shown in FIG. 1B) and to turn the robot 102. In some implementations, the robot 102 includes a caster wheel 211 that supports the body 200 above the floor surface 10. The caster wheel 211, for example, supports the rear portion 202*b* of the body 200 above the floor surface 10, and the drive wheels 210*a*, 210*b* support the front portion 202*a* of the body 200 above the floor surface 10.

As shown in FIGS. 1B and 2A, a vacuum assembly 118 is carried within the body 200 of the robot 102, e.g., in the rear portion 202*b* of the body 200. The controller 212 operates the vacuum assembly 118 to generate an airflow 120 that flows through the air gap 109 near the rollers 104*a*, 104*b*, through the body 200, and out of the body 200. The vacuum assembly 118 includes, for example, an impeller that generates the airflow 120 when rotated. The airflow 120 and the rollers 104*a*, 104*b*, when rotated, cooperate to ingest debris 106 into the robot 102. A cleaning bin 122 mounted in the body 200 contains the debris 106 ingested by the robot 102, and a filter 123 in the body 200 separates the debris 106 from the airflow 120 before the airflow 120 enters the vacuum assembly 118 and is exhausted out of the body 200. In this regard, the debris 106 is captured in both the cleaning bin 122 and the filter 123 before the airflow 120 is exhausted from the body 200.

As shown in FIGS. 1A and 2A, the cleaning head 100 and the rollers 104*a*, 104*b* are positioned in the front portion 202*a* of the body 200 between the lateral sides 204*a*, 204*b*. The rollers 104*a*, 104*b* are operably connected to actuators 214*a*, 214*b*, e.g., motors. The cleaning head 100 and the rollers 104*a*, 104*b* are positioned forward of the cleaning bin 122, which is positioned forward of the vacuum assembly 118. In the example of the robot 102 described with respect to FIGS. 2A, 2B, the substantially rectangular shape of the front portion 202*a* of the body 200 enables the rollers 104*a*, 104*b* to be longer than rollers for cleaning robots with, for example, a circularly shaped body.

The rollers 104*a*, 104*b* are mounted to a housing 124 of the cleaning head 100 and mounted, e.g., indirectly or directly, to the body 200 of the robot 102. In particular, the rollers 104*a*, 104*b* are mounted to an underside of the front portion 202*a* of the body 200 so that the rollers 104*a*, 104*b* engage debris 106 on the floor surface 10 during the cleaning operation when the underside faces the floor surface 10.

In some implementations, the housing 124 of the cleaning head 100 is mounted to the body 200 of the robot 102. In this regard, the rollers 104*a*, 104*b* are also mounted to the body 200 of the robot 102, e.g., indirectly mounted to the body 200 through the housing 124. Alternatively or additionally, the cleaning head 100 is a removable assembly of the robot 102 in which the housing 124 with the rollers 104*a*, 104*b* mounted therein is removably mounted to the body 200 of the robot 102. The housing 124 and the rollers 104*a*, 104*b* are removable from the body 200 as a unit so that the cleaning head 100 is easily interchangeable with a replacement cleaning head.

In some implementations, rather than being removably mounted to the body 200, the housing 124 of the cleaning head 100 is not a component separate from the body 200, but rather, corresponds to an integral portion of the body 200 of the robot 102. The rollers 104*a*, 104*b* are mounted to the body 200 of the robot 102, e.g., directly mounted to the integral portion of the body 200. The rollers 104*a*, 104*b* are each independently removable from the housing 124 of the cleaning head 100 and/or from the body 200 of the robot 102 so that the rollers 104*a*, 104*b* can be easily cleaned or be replaced with replacement rollers. As described herein, the rollers 104*a*, 104*b* can include collection wells for filament debris that can be easily accessed and cleaned by a user when the rollers 104*a*, 104*b* are dismounted from the housing 124.

The rollers 104*a*, 104*b* are rotatable relative to the housing 124 of the cleaning head 100 and relative to the body 200 of the robot 102. As shown in FIGS. 1B and 2A, the rollers 104*a*, 104*b* are rotatable about longitudinal axes 126*a*, 126*b* parallel to the floor surface 10. The axes 126*a*, 126*b* are parallel to one another and correspond to longitudinal axes of the cleaning rollers 104*a*, 104*b*, respectively. In some cases, the axes 126*a*, 126*b* are perpendicular to the forward drive direction 116 of the robot 102. The center 114 of the cleaning roller 104*a* is positioned along the longitudinal axis 126*a* and corresponds to a midpoint of the length L1 of the cleaning roller 104*a*. The center 114, in this regard, is positioned along the axis of rotation of the cleaning roller 104*a*.

Figure 2B:
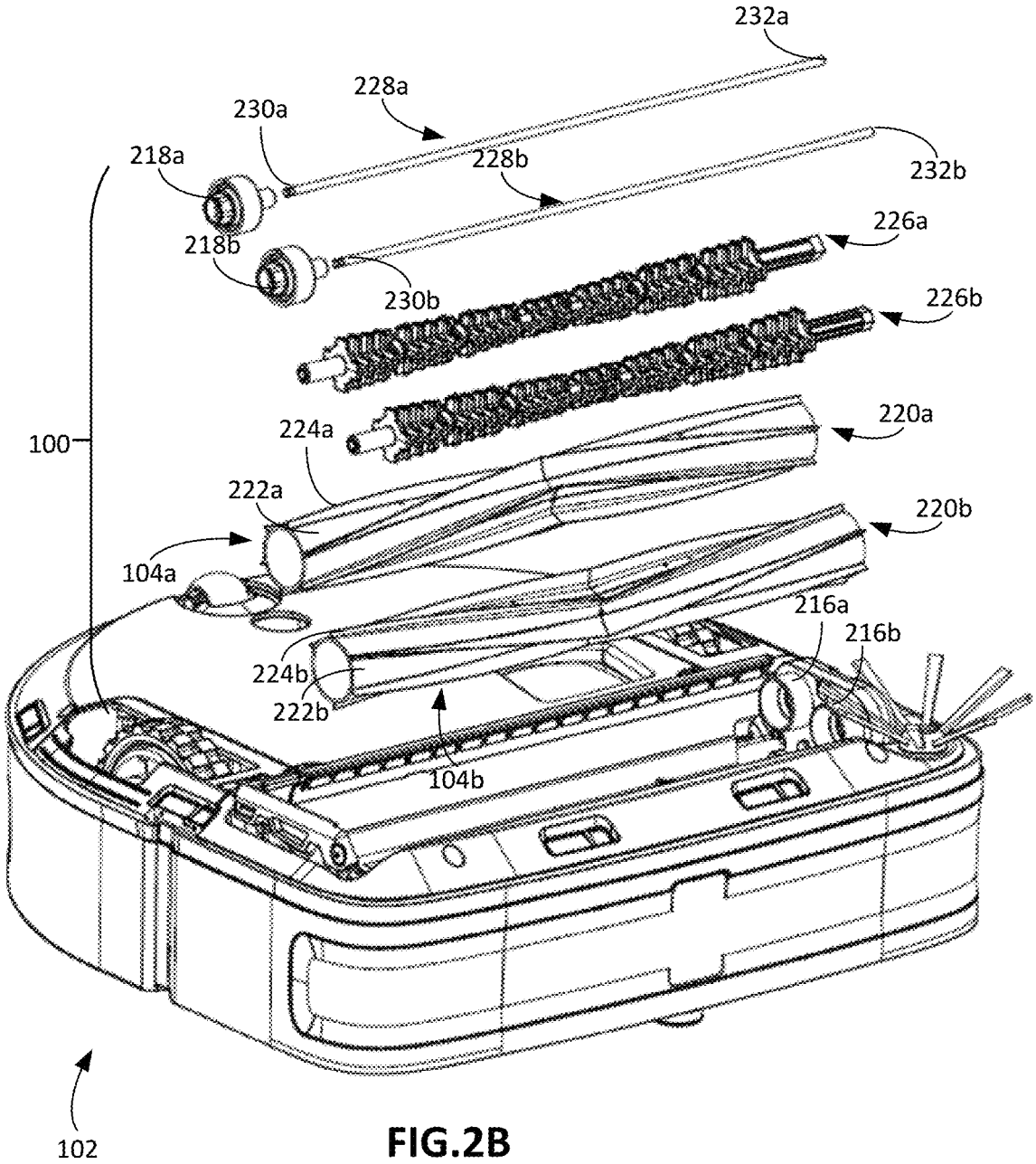
FIG. 2B is a side perspective exploded view of the cleaning robot of FIG. 2A.

In some implementations, referring to the exploded view of the cleaning head 100 shown in FIG. 2B, the rollers 104*a*, 104*b* each include a sheath 220*a*, 220*b* including a shell 222*a*, 222*b* and vanes 224*a*, 224*b*. The rollers 104*a*, 104*b* also each include a support structure 226*a*, 226*b*, and a shaft 228*a*, 228*b*. The sheath 220*a*, 220*b* is, in some cases, a single molded piece formed from an elastomeric material. In this regard, the shell 222*a*, 222*b* and its corresponding vanes 224*a*, 224*b* are part of the single molded piece. The sheath 220*a*, 220*b* extends inward from its outer surface toward the shaft 228*a*, 228*b* such that the amount of material of the sheath 220*a*, 220*b* inhibits the sheath 220*a*, 220*b* from deflecting in response to contact with objects, e.g., the floor surface 10. The high surface friction of the sheath 220*a*, 220*b* enables the sheath 220*a*, 220*b* to engage the debris 106 and guide the debris 106 toward the interior of the cleaning robot 102, e.g., toward an air conduit 128 within the cleaning robot 102.

The shafts 228*a*, 228*b* and, in some cases, the support structure 226*a*, 226*b*, are operably connected to the actuators 214*a*, 214*b* (shown schematically in FIG. 2A) when the rollers 104*a*, 104*b* are mounted to the body 200 of the robot 102. When the rollers 104*a*, 104*b* are mounted to the body 200, mounting devices 216*a*, 216*b* on the second end portions 232*a*, 232*b* of the shafts 228*a*, 228*b* couple the shafts 228*a*, 228*b* to the actuators 214*a*, 214*b*. The first end portions 230*a*, 230*b* of the shafts 228*a*, 228*b* are rotatably mounted to mounting devices 218*a*, 218*b* on the housing 124 of the cleaning head 100 or the body 200 of the robot 102. The mounting devices 218*a*, 218*b* are fixed relative to the housing 124 or the body 200. In some cases, as described herein, portions of the support structure 226*a*, 226*b* cooperate with the shafts 228*a*, 228*b* to rotationally couple the cleaning rollers 104*a*, 104*b* to the actuators 214*a*, 214*b* and to rotatably mount the cleaning rollers 104*a*, 104*b* to the mounting devices 218*a*, 218*b*.

As shown in FIG. 1A, the roller 104*a* and the roller 104*b* are spaced from another such that the longitudinal axis 126*a* of the roller 104*a* and the longitudinal axis 126*b* of the roller 104*b* define a spacing S1. The spacing S1 is, for example, between 2 and 6 cm, e.g., between 2 and 4 cm, 4 and 6 cm, etc.

The roller 104*a* and the roller 104*b* are mounted such that the shell 222*a* of the roller 104*a* and the shell 222*b* of the roller 104*b* define the separation 108. The separation 108 is between the shell 222*a* and the shell 222*b* and extends longitudinally between the shells 222*a*, 222*b*. In particular, the outer surface of the shell 222*b* of the roller 104*b* and the outer surface of the shell 222*a* of the roller are separated by the separation 108, which varies in width along the longitudinal axes 126*a*, 126*b* of the rollers 104*a*, 104*b*. The separation 108 tapers toward the center 114 of the cleaning roller 104*a*, e.g., toward a plane passing through centers of the both of the cleaning rollers 104*a*, 104*b* and perpendicular to the longitudinal axes 126*a*, 126*b*. The separation 108 decreases in width toward the center 114.

The separation 108 is measured as a width between the outer surface of the shell 222*a* and the outer surface of the shell 222*b*. In some cases, the width of the separation 108 is measured as the closest distance between the shell 222*a* and the shell 222*b* at various points along the longitudinal axis 126*a*. The width of the separation 108 is measured along a plane through both of the longitudinal axes 126*a*, 126*b*. In this regard, the width varies such that the distance S3 between the rollers 104*a*, 104*b* at their centers is greater than the distance S2 at their ends.

Referring to inset 132*a* in FIG. 1A, a length S2 of the separation 108 proximate the first end portion 110*a* of the roller 104*a* is between 2 and 10 mm, e.g., between 2 mm and 6 mm, 4 mm and 8 mm, 6 mm and 10 mm, etc. The length S2 of the separation 108, for example, corresponds to a minimum length of the separation 108 along the length L1 of the roller 104*a*. Referring to inset 132*b* in FIG. 1A, a length S3 of the separation 108 proximate the center 114 of the cleaning roller 104*a* is between, for example, 5 mm and 30 mm, e.g., between 5 mm and 20 mm, 10 mm and 25 mm, 15 mm and 30 mm, etc. The length S3 is, for example, 3 to 15 times greater than the length S2, e.g., 3 to 5 times, 5 to 10 times, 10 to 15 times, etc., greater than the length S2. The length S3 of the separation 108, for example, corresponds to a maximum length of the separation 108 along the length L1 of the roller 104*a*. In some cases, the separation 108 linearly increases from the center 114 of the cleaning roller 104 toward the end portions 110*a*, 110*b*.

The air gap 109 between the rollers 104*a*, 104*b* is defined as the distance between free tips of the vanes 224*a*, 224*b* on opposing rollers 104*a*, 104*b*. In some examples, the distance varies depending on how the vanes 224*a*, 224*b* align during rotation. The air gap 109 between the sheaths 220*a*, 220*b* of the rollers 104*a*, 104*b* varies along the longitudinal axes 126*a*, 126*b* of the rollers 104*a*, 104*b*. In particular, the width of the air gap 109 varies in size depending on relative positions of the vanes 224*a*, 224*b* of the rollers 104*a*, 104*b*. The width of the air gap 109 is defined by the distance between the outer circumferences of the sheath 220*a*, 220*b*, e.g., defined by the vanes 224*a*, 224*b*, when the vanes 224*a*, 224*b* face one another during rotation of the rollers 104*a*, 104*b*. The width of the air gap 109 is defined by the distance between the outer circumferences of the shells 222*a*, 222*b* when the vanes 224*a*, 224*b* of both rollers 104*a*, 104*b* do not face the other roller. In this regard, while the outer circumference of the rollers 104*a*, 104*b* is consistent along the lengths of the rollers 104*a*, 104*b* as described herein, the air gap 109 between the rollers 104*a*, 104*b* varies in width as the rollers 104*a*, 104*b* rotate. In particular, while the separation 108 has a constant length during rotation of the opposing rollers 104*a*, 104*b*, the distance defining the air gap 109 changes during the rotation of the rollers 104*a*, 104*b* due to relative motion of the vanes 224*a*, 224*b* of the rollers 104*a*, 104*b*. The air gap 109 will vary in width from a minimum width of 1 mm to 10 mm when the vanes 224*a*, 224*b* face one another to a maximum width of 5 mm to 30 mm when the vanes 224*a*, 224*b* are not aligned. The maximum width corresponds to, for example, the length S3 of the separation 108 at the centers of the cleaning rollers 104*a*, 104*b*, and the minimum width corresponds to the length of this separation 108 minus the heights of the vanes 224*a*, 224*b* at the centers of the cleaning rollers 104*a*, 104*b*.

Referring to FIG. 2A, in some implementations, to sweep debris 106 toward the rollers 104*a*, 104*b*, the robot 102 includes a brush 233 that rotates about a non-horizontal axis, e.g., an axis forming an angle between 75 degrees and 90 degrees with the floor surface 10. The non-horizontal axis, for example, forms an angle between 75 degrees and 90 degrees with the longitudinal axes 126*a*, 126*b* of the cleaning rollers 104*a*, 104*b*. The robot 102 includes an actuator 234 operably connected to the brush 233. The brush 233 extends beyond a perimeter of the body 200 such that the brush 233 is capable of engaging debris 106 on portions of the floor surface 10 that the rollers 104*a*, 104*b* typically cannot reach.

During the cleaning operation shown in FIG. 1B, as the controller 212 operates the actuators 208*a*, 208*b* to navigate the robot 102 across the floor surface 10, if the brush 233 is present, the controller 212 operates the actuator 234 to rotate the brush 233 about the non-horizontal axis to engage debris 106 that the rollers 104*a*, 104*b* cannot reach. In particular, the brush 233 is capable of engaging debris 106 near walls of the environment and brushing the debris 106 toward the rollers 104*a*, 104*b*. The brush 233 sweeps the debris 106 toward the rollers 104*a*, 104*b* so that the debris 106 can be ingested through the separation 108 between the rollers 104*a*, 104*b*.

The controller 212 operates the actuators 214*a*, 214*b* to rotate the rollers 104*a*, 104*b* about the axes 126*a*, 126*b*. The rollers 104*a*, 104*b*, when rotated, engage the debris 106 on the floor surface 10 and move the debris 106 toward the air conduit 128. As shown in FIG. 1B, the rollers 104*a*, 104*b*, for example, counter rotate relative to one another to cooperate in moving debris 106 through the separation 108 and toward the air conduit 128, e.g., the roller 104*a* rotates in a clockwise direction 130*a* while the roller 104*b* rotates in a counterclockwise direction 130*b*.

The controller 212 also operates the vacuum assembly 118 to generate the airflow 120. The vacuum assembly 118 is operated to generate the airflow 120 through the separation 108 such that the airflow 120 can move the debris 106 retrieved by the rollers 104*a*, 104*b*. The airflow 120 carries the debris 106 into the cleaning bin 122 that collects the debris 106 delivered by the airflow 120. In this regard, both the vacuum assembly 118 and the rollers 104*a*, 104*b* facilitate ingestion of the debris 106 from the floor surface 10. The air conduit 128 receives the airflow 120 containing the debris 106 and guides the airflow 120 into the cleaning bin 122. The debris 106 is deposited in the cleaning bin 122. During rotation of the rollers 104*a*, 104*b*, the rollers 104*a*, 104*b* apply a force to the floor surface 10 to agitate any debris on the floor surface 10. The agitation of the debris 106 can cause the debris 106 to be dislodged from the floor surface 10 so that the rollers 104*a*, 104*b* can more contact the debris 106 and so that the airflow 120 generated by the vacuum assembly 118 can more easily carry the debris 106 toward the interior of the robot 102. As described herein, the improved torque transfer from the actuators 214*a*, 214*b* toward the outer surfaces of the rollers 104*a*, 104*b* enables the rollers 104*a*, 104*b* to apply more force. As a result, the rollers 104*a*, 104*b* can better agitate the debris 106 on the floor surface 10 compared to rollers and brushes with reduced torque transfer or rollers and brushes that readily deform in response to contact with the floor surface 10 or with the debris 106.

Example Cleaning Rollers

Figure 3A:
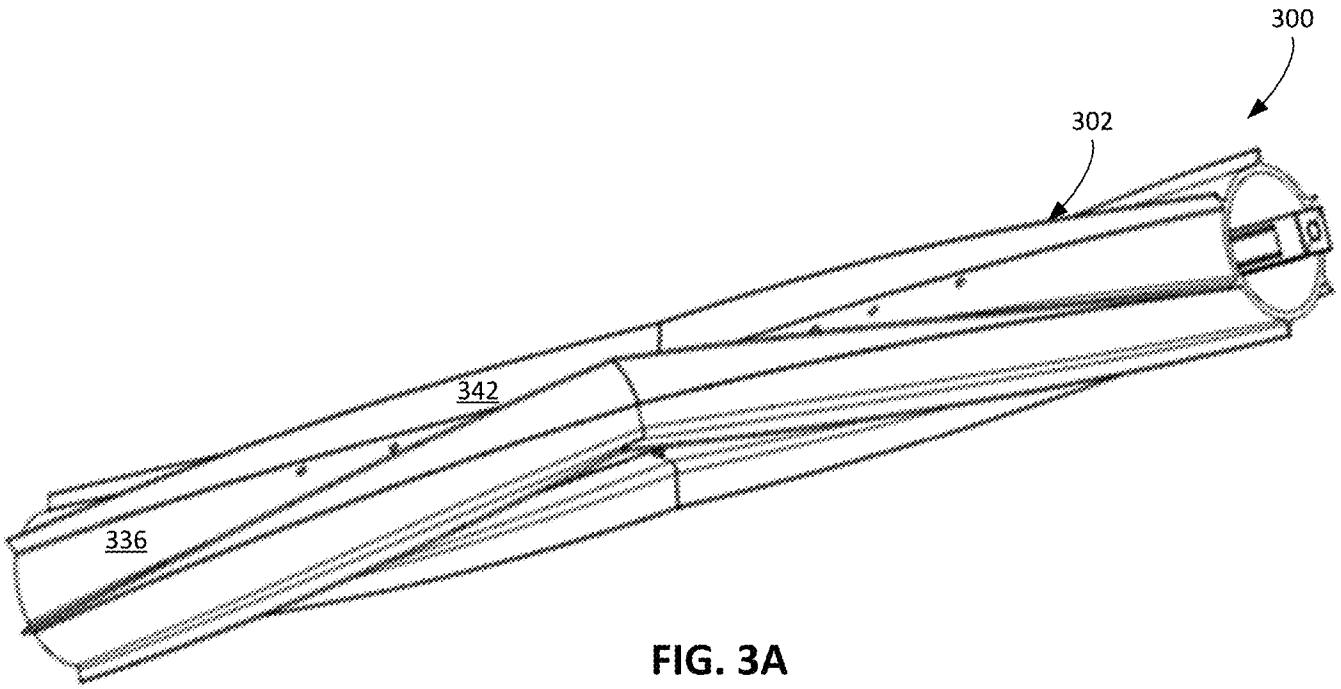
FIG. 3A is a front perspective view of a cleaning roller.
Figure 3B:
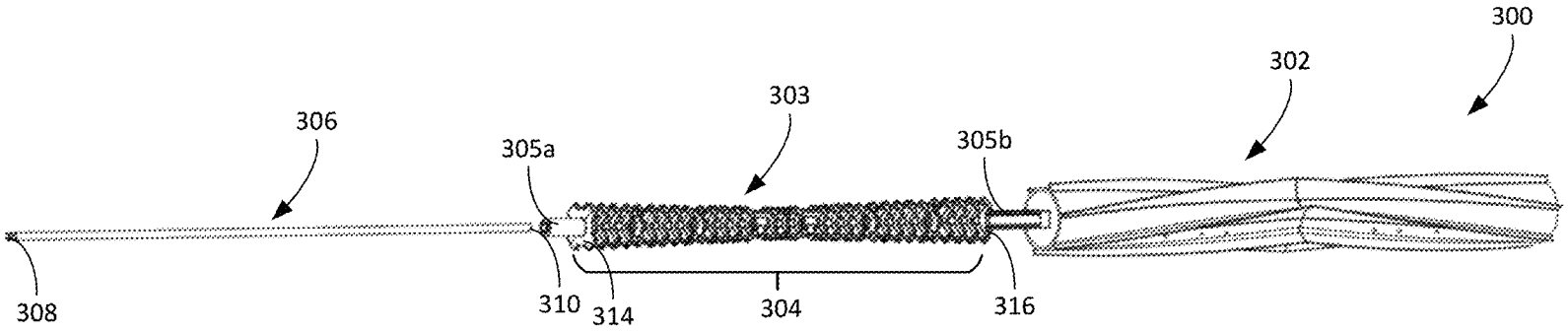
FIG. 3B is a front perspective exploded view of the cleaning roller of FIG. 3A.
Figure 3C:
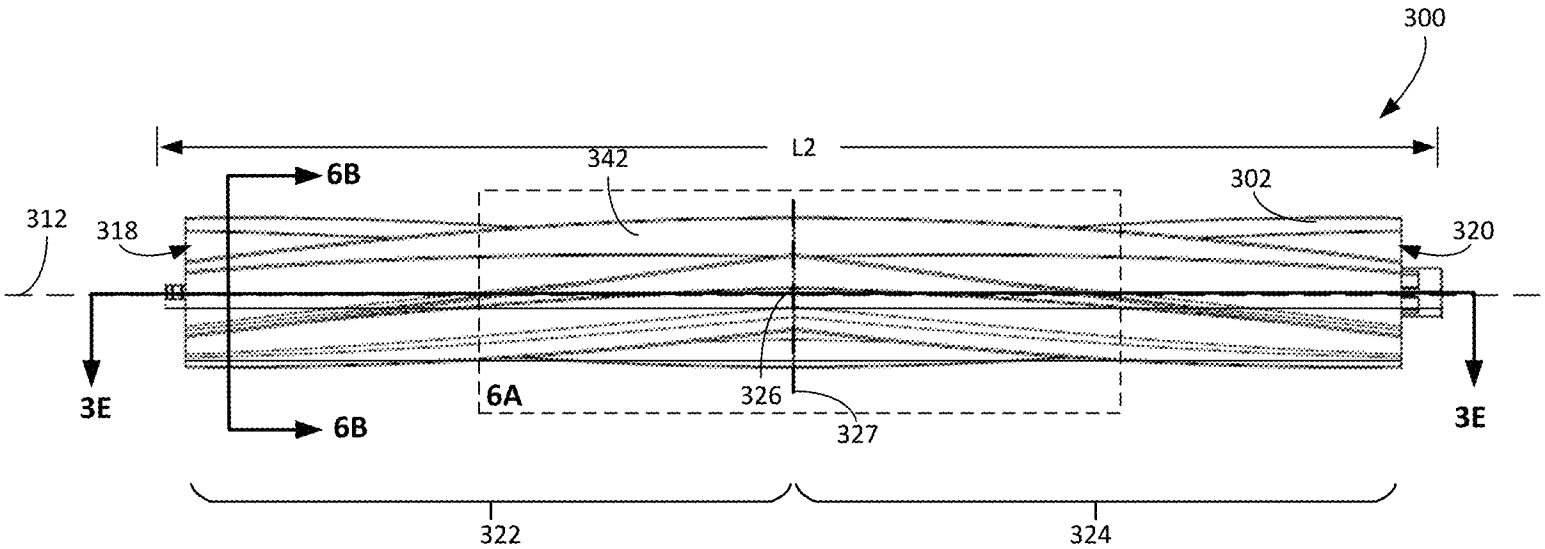
FIG. 3C is a front view of the cleaning roller of FIG. 3A.

The example of the rollers 104*a*, 104*b* described with respect to FIG. 2B can include additional configurations as described with respect to FIGS. 3A-3E, 4A-4D, and 5A-5G. As shown in FIG. 3B, an example of a roller 300 includes a sheath 302, a support structure 303, and a shaft 306. The roller 300, for example, corresponds to the rear roller 104*a* described with respect to FIGS. 1A, 1B, 2A, and 2B. The sheath 302, the support structure 303, and the shaft 306 are similar to the sheath 220*a*, the support structure 226*a*, and the shaft 228*a* described with respect to FIG. 2B. In some implementations, the sheath 220*a*, the support structure 226*a*, and the shaft 228*a* are the sheath 302, the support structure 303, and the shaft 306, respectively. As shown in FIG. 3C, an overall length L2 of the roller 300 is similar to the overall length L1 described with respect to the rollers 104*a*, 104*b*.

Like the cleaning roller 104*a*, the cleaning roller 300 can be mounted to the cleaning robot 102. Absolute and relative dimensions associated with the cleaning robot 102, the cleaning roller 300, and their components are described herein. Some of these dimensions are indicated in the figures by reference characters such as, for example, W1, S1-S3, L1-L10, D1-D7, M1, and M2. Example values for these dimensions in implementations are described herein, for example, in the section "Example Dimensions of Cleaning Robots and Cleaning Rollers."

Referring to FIGS. 3B and 3C, the shaft 306 is an elongate member having a first outer end portion 308 and a second outer end portion 310. The shaft 306 extends from the first end portion 308 to the second end portion 310 along a longitudinal axis 312, e.g., the axis 126*a* about which the roller 104*a* is rotated. The shaft 306 is, for example, a drive shaft formed from a metal material.

The first end portion 308 and the second end portion 310 of the shaft 306 are configured to be mounted to a cleaning robot, e.g., the robot 102. The second end portion 310 is configured to be mounted to a mounting device, e.g., the mounting device 216*a*. The mounting device couples the shaft 306 to an actuator of the cleaning robot, e.g., the actuator 214*a* described with respect to FIG. 2A. The first end portion 308 rotatably mounts the shaft 306 to a mounting device, e.g., the mounting device 218*a*. The second end portion 310 is driven by the actuator of the cleaning robot.

Figure 3D:
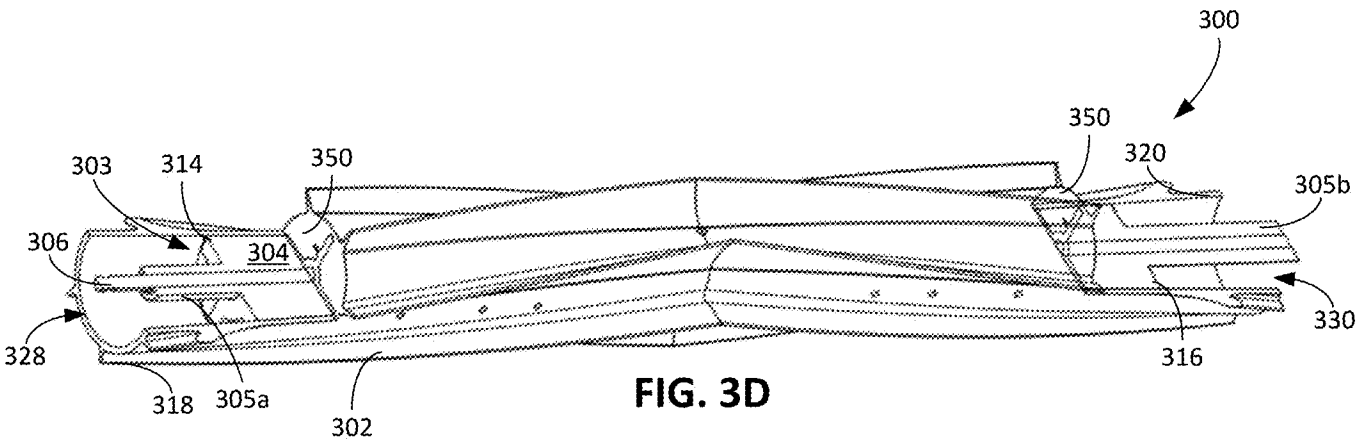
FIG. 3D is a front cutaway view of the cleaning roller of FIG. 3A with portions of a sheath and a support structure of the cleaning roller removed to reveal collection wells of the cleaning roller.
Figure 3E:
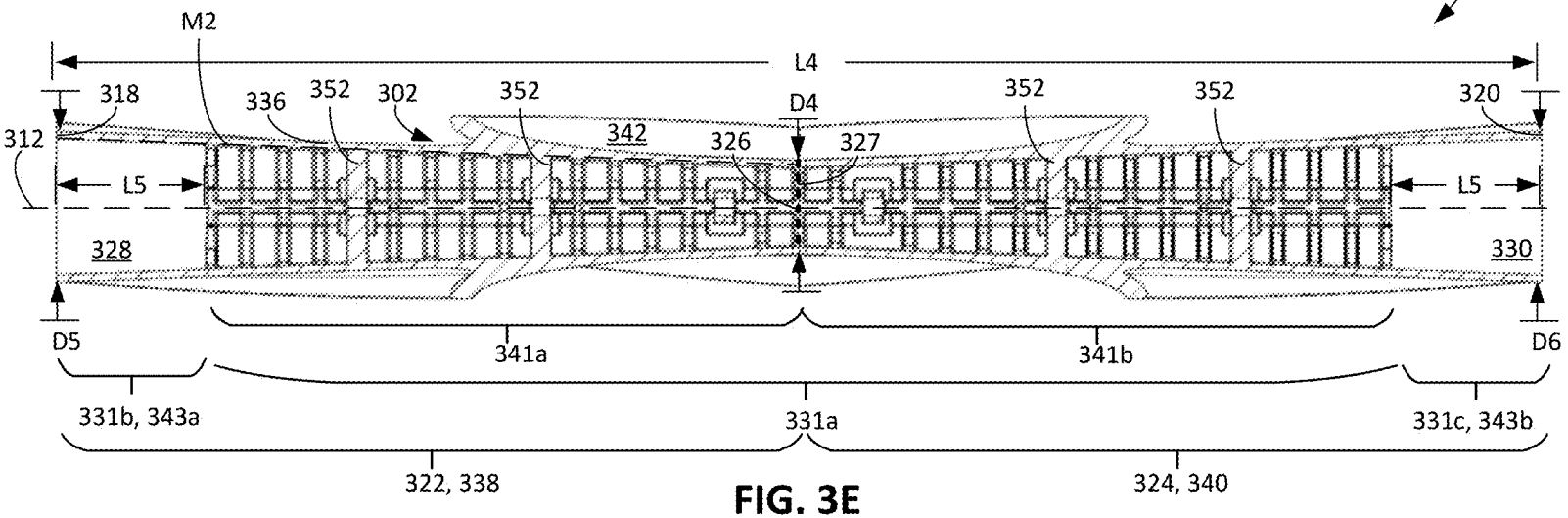
FIG. 3E is a cross-sectional view of the sheath of the cleaning roller of FIG. 3A taken along section 3E-3E shown in FIG. 3C.

Referring to FIG. 3B, the support structure 303 is positioned around the shaft 306 and is rotationally coupled to the shaft 306. The support structure 303 includes a core 304 affixed to the shaft 306. As described herein, the core 304 and the shaft 306 are affixed to one another, in some implementations, through an insert molding process during which the core 304 is bonded to the shaft 306. Referring to FIGS. 3D and 3E, the core 304 includes a first outer end portion 314 and a second outer end portion 316, each of which is positioned along the shaft 306. The first end portion 314 of the core 304 is positioned proximate the first end portion 308 of the shaft 306. The second end portion 316 of the core 304 is positioned proximate the second end portion 310 of the shaft 306. The core 304 extends along the longitudinal axis 312 and encloses portions of the shaft 306.

Figure 4A:
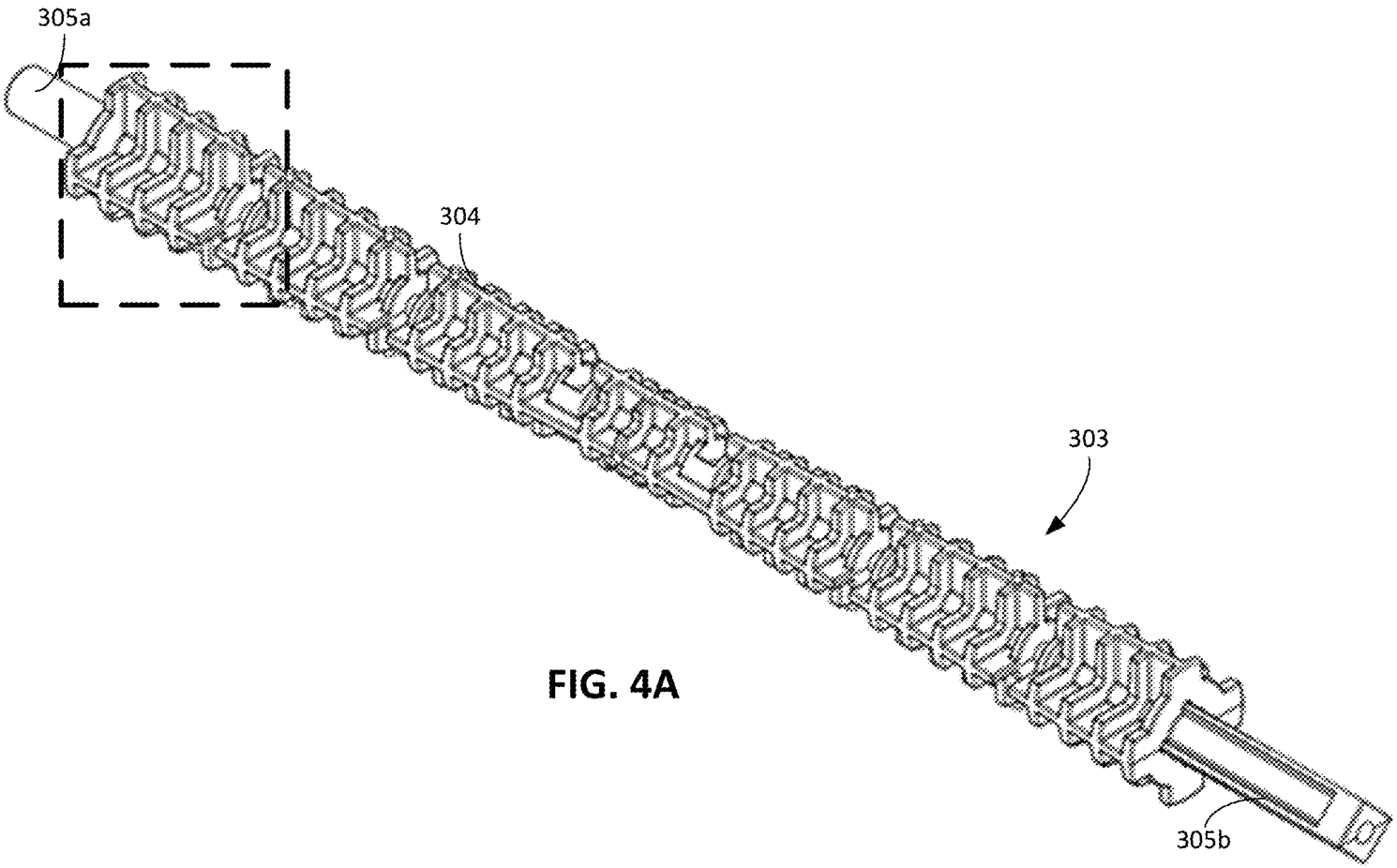
FIG. 4A is a perspective view of a support structure of the cleaning roller of FIG. 3A.

Referring to FIGS. 3D and 4A, in some cases, the support structure 303 further includes an elongate portion 305*a* extending from the first end portion 314 of the core 304 toward the first end portion 308 of the shaft 306 along the longitudinal axis 312 of the roller 300. The elongate portion 305*a* has, for example, a cylindrical shape. The elongate portion 305*a* of the support structure 303 and the first end portion 308 of the shaft 306, for example, are configured to be rotatably mounted to the mounting device, e.g., the mounting device 218*a*. The mounting device 218*a*, 218*b*, for example, functions as a bearing surface to enable the elongate portion 305*a*, and hence the roller 300, to rotate about its longitudinal axis 312 with relatively little frictional forces caused by contact between the elongate portion 305*a* and the mounting device.

In some cases, the support structure 303 includes an elongate portion 305*b* extending from the second end portion 314 of the core 304 toward the second end portion 310 of the shaft 306 along the longitudinal axis 312 of the roller 300. The elongate portion 305*b* of the support structure 303 and the second end portion 314 of the core 304, for example, are coupled to the mounting device, e.g., the mounting device 216*a*. The mounting device 216*a* enables the roller 300 to be mounted to the actuator of the cleaning robot, e.g., rotationally coupled to a motor shaft of the actuator. The elongate portion 305*b* has, for example, a prismatic shape having a non-circular cross-section, such as a square, hexagonal, or other polygonal shape, that rotationally couples the support structure 303 to a rotatable mounting device, e.g., the mounting device 216*a*. The elongate portion 305*b* engages with the mounting device 216*a* to rotationally couple the support structure 303 to the mounting device 216*a*.

The mounting device 216*a* rotationally couples both the shaft 306 and the support structure 303 to the actuator of the cleaning robot, thereby improving torque transfer from the actuator to the shaft 306 and the support structure 303. The shaft 306 can be attached to the support structure 303 and the sheath 302 in a manner that improves torque transfer from the shaft 306 to the support structure 303 and the sheath 302. Referring to FIGS. 3C and 3E, the sheath 302 is affixed to the core 304 of the support structure 303. As described herein, the support structure 303 and the sheath 302 are affixed to one another to rotationally couple the sheath 302 to the support structure 303, particularly in a manner that improves torque transfer from the support structure 303 to the sheath 302 along the entire length of the interface between the sheath 302 and the support structure 303. The sheath 302 is affixed to the core 304, for example, through an overmold or insert molding process in which the core 304 and the sheath 302 are directly bonded to one another. In addition, in some implementations, the sheath 302 and the core 304 include interlocking geometry that ensures that rotational movement of the core 304 drives rotational movement of the sheath 302.

The sheath 302 includes a first half 322 and a second half 324. The first half 322 corresponds to the portion of the sheath 302 on one side of a central plane 327 passing through a center 326 of the roller 300 and perpendicular to the longitudinal axis 312 of the roller 300. The second half 324 corresponds to the other portion of the sheath 302 on the other side of the central plane 327. The central plane 327 is, for example, a bisecting plane that divides the roller 300 into two symmetric halves. In this regard, the fixed portion 331 is centered on the bisecting plane.

The sheath 302 includes a first outer end portion 318 on the first half 322 of the sheath 302 and a second outer end portion 320 on the second half 324 of the sheath 302. The sheath 302 extends beyond the core 304 of the support structure 303 along the longitudinal axis 312 of the roller 300, in particular, beyond the first end portion 314 and the second end portion 316 of the core 304. In some cases, the sheath 302 extends beyond the elongate portion 305*a* along the longitudinal axis 312 of the roller 300, and the elongate portion 305*b* extends beyond the second end portion 320 of the sheath 302 along the longitudinal axis 312 of the roller 300.

In some cases, a fixed portion 331*a* of the sheath 302 extending along the length of the core 304 is affixed to the support structure 303, while free portions 331*b*, 331*c* of the sheath 302 extending beyond the length of the core 304 are not affixed to the support structure 303. The fixed portion 331*a* extends from the central plane 327 along both directions of the longitudinal axis 312, e.g., such that the fixed portion 331*a* is symmetric about the central plane 327. The free portion 331*b* is fixed to one end of the fixed portion 331*a*, and the free portion 331*c* is fixed to the other end of the fixed portion 331*a*.

In some implementations, the fixed portion 331*a* tends to deform relatively less than the free portions 331*b*, 331*c* when the sheath 302 of the roller 300 contacts objects, such as the floor surface 10 and debris on the floor surface 10. In some cases, the free portions 331*b*, 331*c* of the sheath 302 deflect in response to contact with the floor surface 10, while the fixed portions 331*b*, 331*c* are radially compressed. The amount of radially compression of the fixed portions 331*b*, 331*c* is less than the amount of radial deflection of the free portions 331*b*, 331*c* because the fixed portions 331*b*, 331*c* include material that extends radially toward the shaft 306. As described herein, in some cases, the material forming the fixed portions 331*b*, 331*c* contacts the shaft 306 and the core 304.

FIG. 3D depicts a cutaway view of the roller 300 with portions of the sheath 302 removed. Referring to FIGS. 3A, 3D, and 3E, the roller 300 includes a first collection well 328 and a second collection well 330. The collection wells 328, 330 correspond to volumes on ends of the roller 300 where filament debris engaged by the roller 300 tend to collect. In particular, as the roller 300 engages filament debris on the floor surface 10 during a cleaning operation, the filament debris moves over the end portions 318, 320 of the sheath 302, wraps around the shaft 306, and then collects within the collection wells 328, 330. The filament debris wraps around the elongate portions 305*a*, 305*b* of the support structure 303 and can be easily removed from the elongate portions 305*a*, 305*b* by the user. In this regard, the elongate portions 305*a*, 305*b* are positioned within the collection wells 328, 330. The collection wells 328, 330 are defined by the sheath 302, the core 304, and the shaft 306. The collection wells 328, 330 are defined by the free portions of the sheath 302 that extend beyond the end portions 314 and 316 of the core 304.

The first collection well 328 is positioned within the first half 322 of the sheath 302. The first collection well 328 is, for example, defined by the first end portion 314 of the core 304, the elongate portion 305*a* of the support structure 303, the free portion 331*b* of the sheath 302, and the shaft 306. The first end portion 314 of the core 304 and the free portion 331*b* of the sheath 302 define a length L5 of the first collection well 328.

The second collection well 330 is positioned within the second half 324 of the sheath 302. The second collection well 330 is, for example, defined by the second end portion 316 of the core 304, the free portion 331*c* of the sheath 302, and the shaft 306. The second end portion 316 of the core 304 and the free portion 331*c* of the sheath 302 define a length L5 of the second collection well 330.

Referring to FIG. 3E, the sheath 302 tapers along the longitudinal axis 312 of the roller 300 toward the center 326, e.g., toward the central plane 327. Both the first half 322 and the second half 324 of the sheath 302 taper along the longitudinal axis 312 toward the center 326, e.g., toward the central plane 327, over at least a portion of the first half 322 and the second half 324, respectively. The first half 322 tapers from proximate the first outer end portion 308 of the shaft 306 to the center 326, and the second half 324 tapers from proximate the second outer end portion 310 of the shaft 306 to the center 326. In some implementations, the first half 322 tapers from the first outer end portion 318 to the center 326, and the second half 324 tapers from the second outer end portion 320 to the center 326. In some implementations, rather than tapering toward the center 326 along an entire length of the sheath 302, the sheath 302 tapers toward the center 326 along the fixed portion 331*a* of the sheath 302, and the free portions 331*b*, 331*c* of the sheath 302 are not tapered. The degree of tapering of the sheath 302 varies between implementations. Examples of dimensions defining the degree of tapering are described herein elsewhere.

Figure 4B:
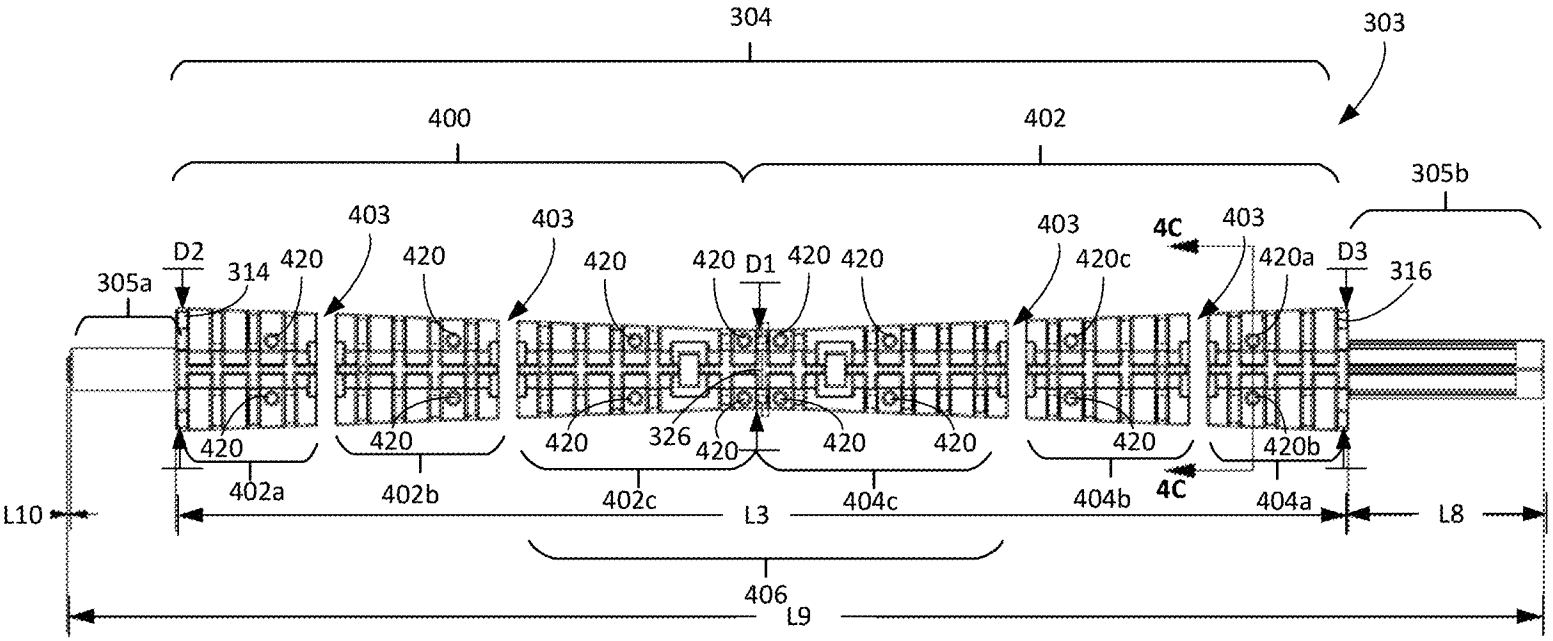
FIG. 4B is a front view of the support structure of FIG. 4A.

Similarly, to enable the sheath 302 to taper toward the center 326 of the roller 300, the support structure 303 includes tapered portions. The core 304 of the support structure 303, for example, includes portions that taper toward the center 326 of the roller 300. FIGS. 4A-4D depict an example configuration of the core 304. Referring to FIGS. 4A and 4B, the core 304 includes a first half 400 including the first end portion 314 and a second half 402 including the second end portion 316. The first half 400 and the second half 402 of the core 304 are symmetric about the central plane 327.

The first half 400 tapers along the longitudinal axis 312 toward the center 326 of the roller 300, and the second half 402 tapers toward the center 326 of the roller 300, e.g., toward the central plane 327. In some implementations, the first half 400 of the core 304 tapers from the first end portion 314 toward the center 326, and the second half 402 of the core 304 tapers along the longitudinal axis 312 from the second end portion 316 toward the center 326. In some cases, the core 304 tapers toward the center 326 along an entire length L3 of the core 304. In some cases, an outer diameter D1 of the core 304 near or at the center 326 of the roller 300 is smaller than outer diameters D2, D3 of the core 304 near or the first and second end portions 314, 316 of the core 304. The outer diameters of the core 304, for example, linearly decreases along the longitudinal axis 312 of the roller 300, e.g., from positions along the longitudinal axis 312 at both of the end portions 314, 316 to the center 326.

In some implementations, the core 304 of the support structure 303 tapers from the first end portion 314 and the second end portion 316 toward the center 326 of the roller 300, and the elongate portions 305*a*, 305*b* are integral to the core 304. The core 304 is affixed to the shaft 306 along the entire length L3 of the core 304. By being affixed to the core 304 along the entire length L3 of the core 304, torque applied to the core 304 and/or the shaft 306 can transfer more evenly along the entire length L3 of the core 304.

In some implementations, the support structure 303 is a single monolithic component in which the core 304 extends along the entire length of the support structure 303 without any discontinuities. The core 304 is integral to the first end portion 314 and the second end portion 316. Alternatively, referring to FIG. 4B, the core 304 includes multiple discontinuous sections that are positioned around the shaft 306, positioned within the sheath 302, and affixed to the sheath 302. The first half 400 of the core 304 includes, for example, multiple sections 402*a*, 402*b*, 402*c*. The sections 402*a*, 402*b*, 402*c* are discontinuous with one another such that the core 304 includes gaps 403 between the sections 402*a*, 402*b* and the sections 402*b*, 402*c*. Each of the multiple sections 402*a*, 402*b*, 402*c* is affixed to the shaft 306 so as to improve torque transfer from the shaft 306 to the core 304 and the support structure 303. In this regard, the shaft 306 mechanically couples each of the multiple sections 402*a*, 402*b*, 402*c* to one another such that the sections 402*a*, 402*b*, 402*c* jointly rotate with the shaft 306. Each of the multiple sections 402*a*, 402*b*, 402*c* is tapered toward the center 326 of the roller 300. The multiple sections 402*a*, 402*b*, 402*c*, for example, each taper away from the first end portion 314 of the core 304 and taper toward the center 326. The elongate portion 305*a* of the support structure 303 is fixed to the section 402*a* of the core 304, e.g., integral to the section 402*a* of the core 304.

Similarly, the second half 402 of the core 304 includes, for example, multiple sections 404*a*, 404*b*, 404*c* discontinuous with one another such that the core 304 includes gaps 403 between the sections 404*a*, 404*b* and the sections 404*b*, 404*c*. Each of the multiple sections 404*a*, 404*b*, 404*c* is affixed to the shaft 306. In this regard, the shaft 306 mechanically couples each of the multiple sections 404*a*, 404*b*, 404*c* to one another such that the sections 404*a*, 404*b*, 404*c* jointly rotate with the shaft 306. The second half 402 of the core 304 accordingly rotates jointly with the first half 400 of the core 304. Each of the multiple sections 404*a*, 404*b*, 404*c* is tapered toward the center 326 of the roller 300. The multiple sections 404*a*, 404*b*, 404*c*, for example, each taper away from the second end portion 314 of the core 304 and taper toward the center 326. The elongate portion 305*b* of the support structure 303 is fixed to the section 404*a* of the core 304, e.g., integral to the section 404*a* of the core 304.

In some cases, the section 402*c* of the first half 400 closest to the center 326 and the section 404*c* of the second half 402 closest to the center 326 are continuous with one another. The section 402*c* of the first half 400 and the section 404*c* of the second half 402 form a continuous section 406 that extends from the center 326 outwardly toward both the first end portion 314 and the second end portion 316 of the core 304. In such examples, the core 304 includes five distinct, discontinuous sections 402*a*, 402*b*, 406, 404*a*, 404*b*. Similarly, the support structure 303 includes five distinct, discontinuous portions. The first of these portions includes the elongate portion 305*a* and the section 402*a* of the core 304. The second of these portions corresponds to the section 402*b* of the core 304. The third of these portions corresponds to the continuous section 406 of the core 304. The fourth of these portions corresponds to the section 404*b* of the core 304. The fifth of these portions includes the elongate portion 305*b* and the section 404*a* of the core 304. While the core 304 and the support structure 303 are described as including five distinct and discontinuous portions, in some implementations, the core 304 and the support structure 303 include fewer or additional discontinuous portions.

Figure 4D:
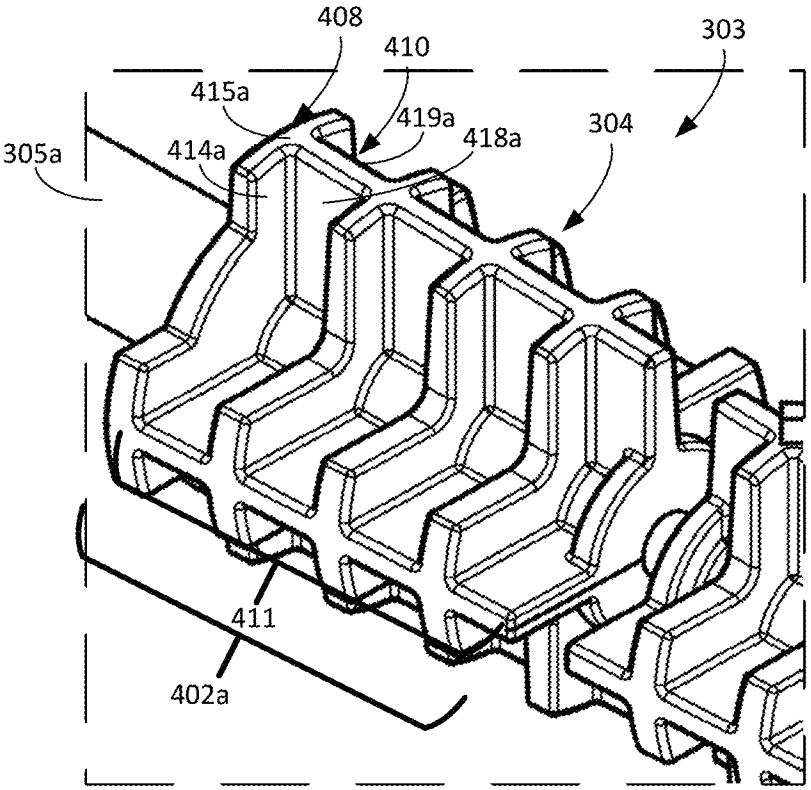
FIG. 4D is a zoomed in perspective view of an inset 4D marked in FIG. 4A depicting an end portion of the subassembly of FIG. 4A.
Figure 4C:
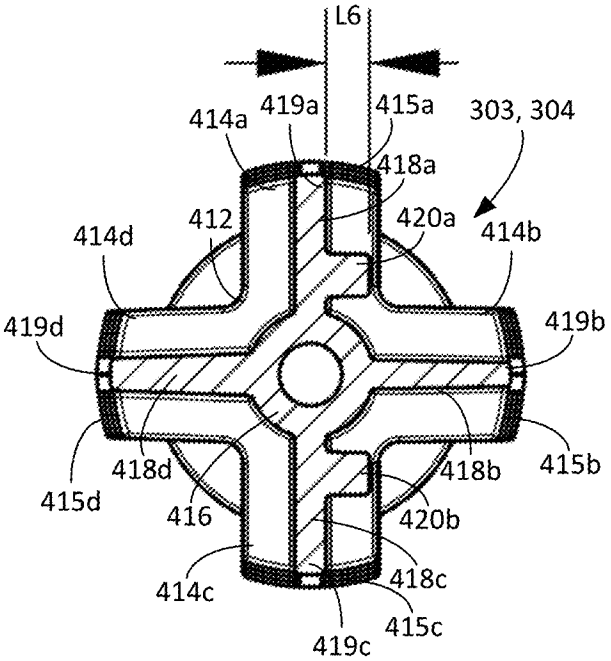
FIG. 4C is a cross sectional view of an end portion of the support structure of FIG. 4B taken along section 4C-4C shown in FIG. 4B.

Referring to both FIGS. 4C and 4D, the first end portion 314 of the core 304 includes alternating ribs 408, 410. The ribs 408, 410 each extend radially outwardly away from the longitudinal axis 312 of the roller 300. The ribs 408, 410 are continuous with one another and form the section 402*a*.

The transverse rib 408 extends transversely relative to the longitudinal axis 312. The transverse rib 408 includes a ring portion 412 fixed to the shaft 306 and lobes 414*a*-414*d* extending radially outwardly from the ring portion 412. In some implementations, the lobes 414*a*-414*d* are axisymmetric about the ring portion 412, e.g., axisymmetric about the longitudinal axis 312 of the roller 300.

The longitudinal rib 410 extends longitudinal along the longitudinal axis 312. The rib 410 includes a ring portion 416 fixed to the shaft 306 and lobes 418*a*-418*d* extending radially outwardly from the ring portion 416. The lobes 418*a*-418*d* are axisymmetric about the ring portion 416, e.g., axisymmetric about the longitudinal axis 312 of the roller 300.

The ring portion 412 of the rib 408 has a wall thickness greater than a wall thickness of the ring portion 416 of the rib 410. The lobes 414*a*-414*d* of the rib 408 have wall thicknesses greater than wall thicknesses of the lobes 418*a*-418*d* of the rib 410.

Free ends 415*a*-415*d* of the lobes 414*a*-414*d* define outer diameters of the ribs 408, and free ends 419*a*-419*d* of the lobes 418*a*-418*d* define outer diameters of the ribs 410. A distance between the free ends 415*a*-415*d*, 419*a*-419*d* and the longitudinal axis 312 define widths of the ribs 408, 410. In some cases, the widths are outer diameters of the ribs 408, 410. The free ends 415*a*-415*d*, 419*a*-419*d* are arcs coincident with circles centered along the longitudinal axis 312, e.g., are portions of the circumferences of these circles. The circles are concentric with one another and with the ring portions 412, 416. In some cases, an outer diameter of ribs 408, 410 closer to the center 326 is greater than an outer diameter of ribs 408, 410 farther from the center 326. The outer diameters of the ribs 408, 410 decrease linearly from the first end portion 314 to the center 326, e.g., to the central plane 327. In particular, as shown in FIG. 4D, the ribs 408, 410 form a continuous longitudinal rib 411 that extends along a length of the section 402*a*. The rib extends radially outwardly from the longitudinal axis 312. The height of the rib 411 relative to the longitudinal axis 312 decreases toward the center 327. The height of the rib 411, for example, linearly decreases toward the center 327.

In some implementations, referring also to FIG. 4B, the core 304 of the support structure 303 includes posts 420 extending away from the longitudinal axis 312 of the roller 300. The posts 420 extend, for example, from a plane extending parallel to and extending through the longitudinal axis 312 of the roller 300. As described herein, the posts 420 can improve torque transfer between the sheath 302 and the support structure 303. The posts 420 extend into the sheath 302 to improve the torque transfer as well as to improve bond strength between the sheath 302 the support structure 303. The posts 420 can stabilize and mitigate vibration in the roller 300 by balancing mass distribution throughout the roller 300.

In some implementations, the posts 420 extend perpendicular to a rib of the core 304, e.g., perpendicular to the lobes 418*a*, 418*c*. The lobes 418*a*, 418*c*, for example, extend perpendicularly away from the longitudinal axis 312 of the roller 300, and the posts 420 extend from the lobe 418*a*, 418*c* and are perpendicular to the lobes 418*a*, 418*c*. The posts 420 have a length L6, for example, between 0.5 and 4 mm, e.g., 0.5 to 2 mm, 1 mm to 3 mm, 1.5 mm to 3 mm, 2 mm to 4 mm, etc.

In some implementations, the core 304 includes multiple posts 420*a*, 420*b* at multiple positions along the longitudinal axis 312 of the roller 300. The core 304 includes, for example, multiple posts 420*a*, 420*c* extending from a single transverse plane perpendicular to the longitudinal axis 312 of the roller 300. The posts 420*a*, 420*c* are, for instance, symmetric to one another along a longitudinal plane extending parallel to and extending through the longitudinal axis 312 of the roller 300. The longitudinal plane is distinct from and perpendicular to the transverse plane from which the posts 420*a*, 420*c* extend. In some implementations, the posts 420*a*, 420*c* at the transverse plane are axisymmetrically arranged about the longitudinal axis 312 of the roller 300.

While four lobes are depicted for each of the ribs 408, 410, in some implementations, the ribs 408, 410 include fewer or additional lobes. While FIGS. 4C and 4D are described with respect to the first end portion 314 and the section 402*a* of the core 304, the configurations of the second end portion 316 and the other sections 402*b*, 402*c*, and 404*a*-404*c* of the core 304 may be similar to the configurations described with respect to the examples in FIGS. 4C and 4D. The first half 400 of the core 304 is, for example, symmetric to the second half 402 about the central plane 327.

The sheath 302 positioned around the core 304 has a number of appropriate configurations. FIGS. 3A-3E depict one example configuration. The sheath 302 includes a shell 336 surrounding and affixed to the core 304. The shell 336 include a first half 338 and a second half 340 symmetric about the central plane 327. The first half 322 of the sheath 302 includes the first half 338 of the shell 336, and the second half 324 of the sheath 302 includes the second half 340 of the shell 336.

In some implementations, the first half 338 and the second half 340 of the shell 336 include frustoconical portions 341*a*, 341*b* and cylindrical portions 343*a*, 343*b*. Central axes of the frustoconical portions 341*a*, 341*b* and cylindrical portions 343*a*, 343*b* each extend parallel to and through the longitudinal axis 312 of the roller 300.

The free portions 331*b*, 331*c* of the sheath 302 include the cylindrical portions 343*a*, 343*b*. In this regard, the cylindrical portions 343*a*, 343*b* extend beyond the end portions 314, 316 of the core 304. The cylindrical portions 343*a*, 343*b* are tubular portions having inner surfaces and outer surfaces. The collection wells 328, 330 are defined by inner surfaces of the cylindrical portions 343*a*, 343*b*.

The fixed portion 331*a* of the sheath 302 includes the frustoconical portions 341*a*, 341*b* of the shell 336. The frustoconical portions 341*a*, 341*b* extend from the central plane 327 along the longitudinal axis 312 toward the end portions 318, 320 of the sheath 302. The frustoconical portions 341*a*, 341*b* are arranged on the core 304 of the support structure 303 such that an outer diameter of the shell 336 decreases toward the center 326 of the roller 300, e.g., toward the central plane 327. An outer diameter D4 of the shell 336 at the central plane 327 is, for example, less than outer diameters D5, D6 of the shell 336 at the outer end portions 318, 320 of the sheath 302. Whereas the inner surfaces of the cylindrical portions 343*a*, 343*b* are free, inner surfaces of the frustoconical portions 341*a*, 341*b* are fixed to the core 304. In some cases, the outer diameter of the shell 336 linearly decreases toward the center 326.

While the sheath 302 is described as having cylindrical portions 343*a*, 343*b*, in some implementations, the portions 343*a*, 343*b* are part of the frustoconical portions 341*a*, 341*b* and are also tapered. The frustoconical portions 341*a*, 341*b* extend along the entire length of the sheath 302. In this regard, the collection wells 328, 330 are defined by inner surfaces of the frustoconical portions 341*a*, 341*b*.

Referring to FIG. 3D, the shell 336 includes core securing portions 350 affixed to the lobes of the core 304, e.g., the lobes 414*a*-414*d*, 418*a*-418*d*. In particular, the core securing portions 350 fix the frustoconical portions 341*a*, 341*b* to the core 304. Each core securing portion 350 extends radially inwardly from the outer surface of the shell 336 and is affixed to the lobes of the core 304. For example, the core securing portions 350 interlock with the core 304 to enable even torque transfer from the core 304 to the frustoconical portions 341*a*, 341*b*. In particular, the core securing portions 350 are positioned between the lobes 414*a*-414*d*, 418*a*-418*d* of the core 304 such that the core 304 can more easily drive the shell 336 and hence the sheath 302 as the core 304 is rotated. The core securing portions 350 are, for example, wedge-shaped portions that extend circumferentially between adjacent lobes 414*a*-414*d*, 418*a*-418*d* of the core 304 and extend radially inwardly toward the ring portions 412, 416 of the core 304.

Referring to FIG. 3E, the shell 336 further includes a shaft securing portion 352 that extends radially inwardly from the outer surface of the shell 336 toward the shaft 306. The shaft securing portion 352 fixes the frustoconical portions 341*a*, 341*b* to the shaft 306. In particular, the shaft securing portion 352 extends between the discontinuous sections 402*a*, 402*b*, 402*c* inwardly to the shaft 306, enabling the shaft securing portion 352 to fix the sheath 302 to the shaft 306. In this regard, the sheath 302 is affixed to the support structure 303 through the core 304, and the sheath 302 is affixed to the shaft 306 through the gaps 403 (shown in FIG. 4B) between the discontinuous sections of the core 304 that enable direct contact between the sheath 302 and the shaft 306. In some cases, as described herein, the shaft securing portion 352 directly bonds to the shaft 306 during the overmold process to form the sheath 302.

Because the shaft 306 is affixed to both the core 304 and the shaft 306, torque delivered to the shaft 306 can be easily transferred to the sheath 302. The increased torque transfer can improve the ability of the sheath 302 to pick up debris from the floor surface 10. The torque transfer can be constant along the length of the roller 300 because of the interlocking interface between the sheath 302 and the core 304. In particular, the core securing portions 350 of the shell 336 interlock with the core 304. The outer surface of the shell 336 can rotate at the same or at a similar rate as the shaft 306 along the entire length of the interface between the shell 336 and the core 304.

In some implementations, the sheath 302 of the roller 300 is a monolithic component including the shell 336 and cantilevered vanes extending substantially radially from the outer surface of the shell 336. Each vane has one end fixed to the outer surface of the shell 336 and another end that is free. The height of each vane is defined as the distance from the fixed end at the shell 336, e.g., the point of attachment to the shell 336, to the free end. The free end sweeps an outer circumference of the sheath 302 during rotation of the roller 300. The outer circumference is consistent along the length of the roller 300. Because the radius from the axis 312 to the outer surface of the shell 336 decreases from the ends 318, 320 of the sheath 302 to the center 327, the height of each vane increases from the ends 318, 320 of the sheath 302 to the center 327 so that the outer circumference of the roller 300 is consistent across the length of the roller 300. In some implementations, the vanes are chevron shaped such that each of the two legs of each vane start at opposing ends 318, 320 of the sheath 302, and the two legs meet at an angle at the center 327 of the roller 300 to form a "V" shape. The tip of the V precedes the legs in the direction of rotation.

Figure 5A:
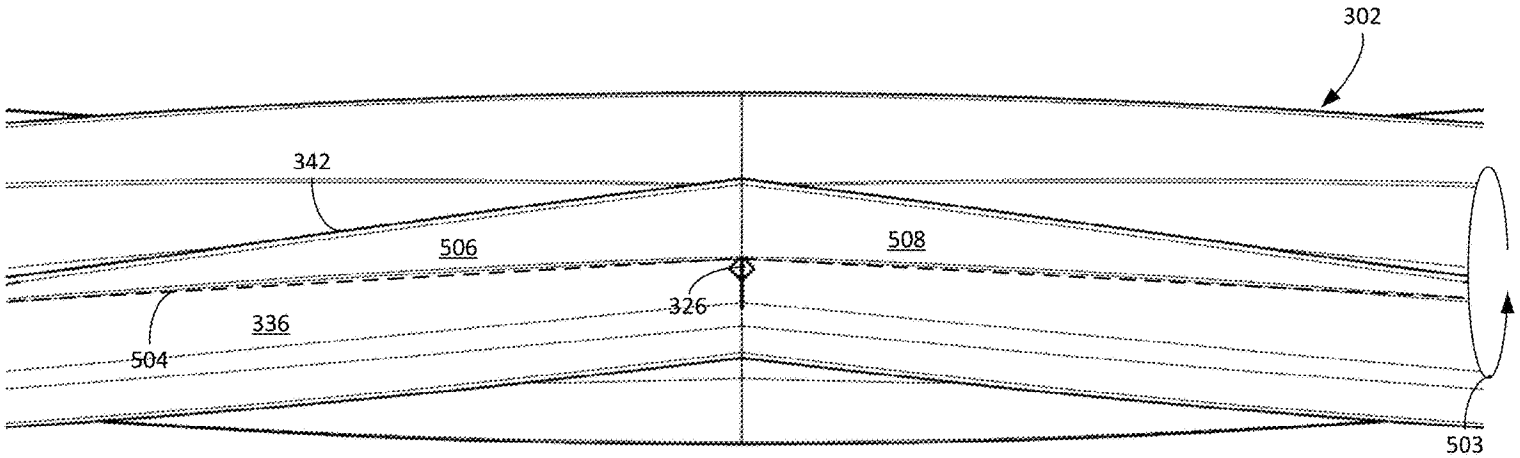
FIG. 5A is a zoomed in view of an inset 5A marked in FIG. 3C depicting a central portion of the cleaning roller of FIG. 3C.
Figure 5B:
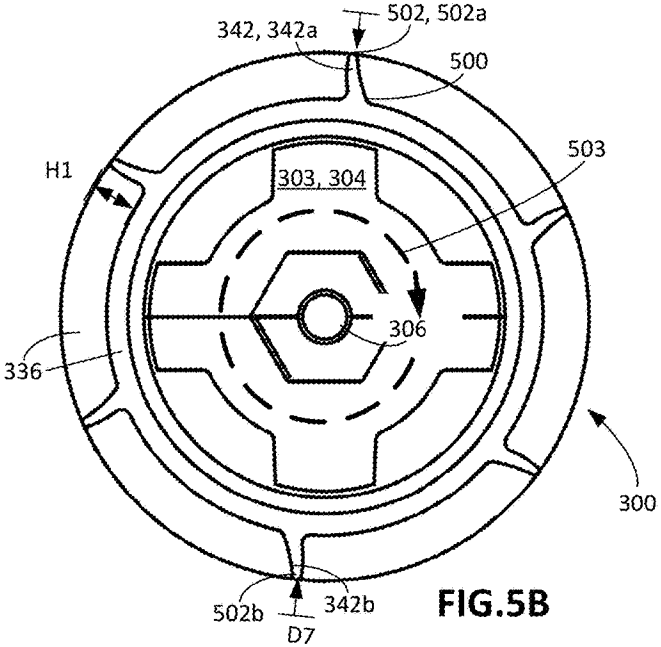
FIG. 5B is a cross-sectional view of an end portion of the cleaning roller of FIG. 3C taken along section 5B-5B shown in FIG. 3C.

FIGS. 5A and 5B depict one example of the sheath 302 including one or more vanes on an outer surface of the shell 336. Referring to FIG. 3C, while a single vane 342 is described herein, the roller 300 includes multiple vanes in some implementations, with each of the multiple vanes being similar to the vane 342 but arranged at different locations along the outer surface of the shell 336. The vane 342 is a deflectable portion of the sheath 302 that, in some cases, engages with the floor surface 10 when the roller 300 is rotated during a cleaning operation. The vane 342 extends along outer surface of the cylindrical portions 343*a*, 343*b* and the frustoconical portions 341*a*, 341*b* of the shell 336. The vane 342 extends radially outwardly from the sheath 302 and away from the longitudinal axis 312 of the roller 300. The vane 342 deflects when it contacts the floor surface 300 as the roller 300 rotates.

Referring to FIG. 5B, the vane 342 extends from a first end 500 fixed to the shell 336 and a second free end 502. A height of the vane 342 corresponds to, for example, a height H1 measured from the first end 500 to the second end 502, e.g., a height of the vane 342 measured from the outer surface of the shell 336. The height H1 of the vane 342 proximate the center 326 of the roller 300 is greater than the height H1 of the vane 342 proximate the first end portion 308 and the second portion 310 of the shaft 306. The height H1 of the vane 342 proximate the center of the roller 300 is, in some cases, a maximum height of the vane 342. In some cases, the height H1 of the vane 342 linearly decreases from the center 326 of the roller 300 toward the first end portion 308 of the shaft 306. In some cases, the height H1 of the vane 342 is uniform across the cylindrical portions 343*a*, 343*b* of the shell 336, and linearly decreases in height along the frustoconical portions 341*a*, 341*b* of the shell 336. In some implementations, the vane 342 is angled rearwardly relative to a direction of rotation 503 of the roller 300 such that the vane 342 more readily deflects in response to contact with the floor surface 10.

Referring to FIG. 5A, the vane 342 follows, for example, a V-shaped path 504 along the outer surface of the shell 336. The V-shaped path 504 includes a first leg 506 and a second leg 508 that each extend from the central plane 327 toward the first end portion 318 and the second end portion 320 of the sheath 302, respectively. The first and second legs 506, 508 extend circumferentially along the outer surface of the shell 336, in particular, in the direction of rotation 503 of the roller 300. The height H1 of the vane 342 decreases along the first leg 506 of the path 504 from the central plane 327 toward the first end portion 318, and the height H1 of the vane 342 decreases along the second leg 508 of the path 504 from the central plane 327 toward the second end portion 320. In some cases, the height of the vanes 342 decreases linearly from the central plane 327 toward the second portion 320 and decreases linearly from the central plane 327 toward the first end portion 318.

In some cases, an outer diameter D7 of the sheath 302 corresponds to a distance between free ends 502*a*, 502*b* of vanes 342*a*, 342*b* arranged on opposite sides of a plane through the longitudinal axis 312 of the roller 300. The outer diameter D7 of the sheath 302 is, in some cases, uniform across the entire length of the sheath 302. In this regard, despite the taper of the frustoconical portions 341*a*, 341*b* of the shell 336, the outer diameter of the sheath 302 is uniform across the length of the sheath 302 because of the varying height of the vanes 342*a*, 342*b* of the sheath 302.

When the roller 300 is paired with another roller, e.g., the roller 104*b*, the outer surface of the shell 336 of the roller 300 and the outer surface of the shell 336 of the other roller defines a separation therebetween, e.g., the separation 108 described herein. The rollers define an air gap therebetween, e.g., the air gap 109 described herein. Because of the taper of the frustoconical portions 341*a*, 341*b*, the separation increases in size toward the center 326 of the roller 300. The frustoconical portions 341*a*, 341*b*, by being tapered inward toward the center 326 of the roller 300, facilitate movement of filament debris picked up by the roller 300 toward the end portions 318, 320 of the sheath 302. The filament debris can then be collected into the collection wells 328, 330 such that a user can easily remove the filament debris from the roller 300. In some examples, the user dismounts the roller 300 from the cleaning robot to enable the filament debris collected within the collection wells 328, 330 to be removed.

In some cases, the air gap varies in size because of the taper of the frustoconical portions 341*a*, 341*b*. In particular, the width of the air gap depends on whether the vanes 342*a*, 342 of the roller 300 faces the vanes of the other roller. While the width of the air gap between the sheath 302 of the roller 300 and the sheath between the other roller varies along the longitudinal axis 312 of the roller 300, the outer circumferences of the rollers are consistent. As described with respect to the roller 300, the free ends 502*a*, 502*b* of the vanes 342*a*, 342*b* define the outer circumference of the roller 300. Similarly, free ends of the vanes of the other roller define the outer circumference of the other roller. If the vanes 342*a*, 342*b* face the vanes of the other roller, the width of the air gap corresponds to a minimum width between the roller 300 and the other roller, e.g., a distance between the outer circumference of the shell 336 of the roller 300 and the outer circumference of the shell of the other roller. If the vanes 342*a*, 342*b* of the roller and the vanes of the other roller are positioned such that the air gap is defined by the distance between the shells of the rollers, the width of the air gap corresponds to a maximum width between the rollers, e.g., between the free ends 502*a*, 502*b* of the vanes 342*a*, 342*b* of the roller 300 and the free ends of the vanes of the other roller.

Example Dimensions of Cleaning Robots and Cleaning Rollers

Figure 6:
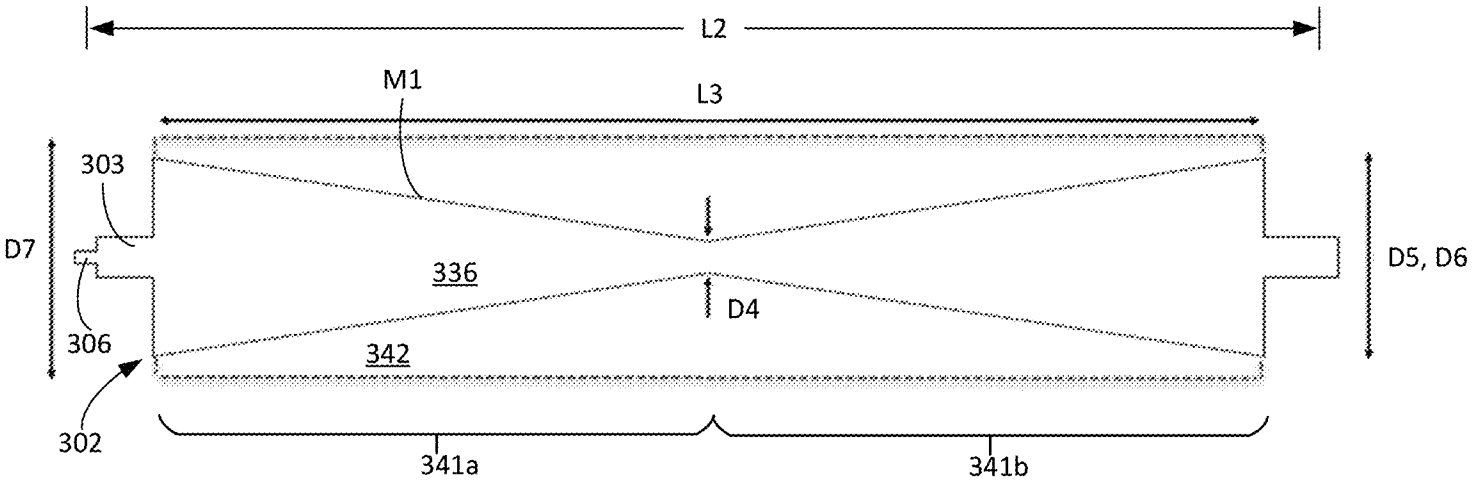
FIG. 6 is a schematic diagram of the cleaning roller of FIG. 3A with free portions of a sheath of the cleaning roller removed.

Dimensions of the cleaning robot 102, the roller 300, and their components vary between implementations. Referring to FIG. 3E and FIG. 6, in some examples, the length L2 of the roller 300 corresponds to the length between the outer end portions 308, 310 of the shaft 306. In this regard, a length of the shaft 306 corresponds to the overall length L2 of the roller 300. The length L2 is between, for example, 10 cm and 50 cm, e.g., between 10 cm and 30 cm, 20 cm and 40 cm, 30 cm and 50 cm. The length L2 of the roller 300 is, for example, between 70% and 90% of an overall width W1 of the robot 102 (shown in FIG. 2A), e.g., between 70% and 80%, 75% and 85%, and 80% and 90%, etc., of the overall width W1 of the robot 102. The width W1 of the robot 102 is, for instance, between 20 cm and 60 cm, e.g., between 20 cm and 40 cm, 30 cm and 50 cm, 40 cm and 60 cm, etc.

Referring to FIG. 3E, the length L3 of the core 304 is between 8 cm and 40 cm, e.g., between 8 cm and 20 cm, 20 cm and 30 cm, 15 cm and 35 cm, 25 cm and 40 cm, etc. The length L3 of the core 304 corresponds to, for example, the combined length of the frustoconical portions 341*a*, 341*b* of the shell 336 and the length of the fixed portion 331*a* of the sheath 302. The length L3 of the core 304 is between 70% and 90% the length L2 of the roller 300, e.g., between 70% and 80%, 70% and 85%, 75% and 90%, etc., of the length L2 of the roller 300. A length L4 of the sheath 302 is between 9.5 cm and 47.5 cm, e.g., between 9.5 cm and 30 cm, 15 cm and 30 cm, 20 cm and 40 cm, 20 cm and 47.5 cm, etc. The length L4 of the sheath 302 is between 80% and 99% of the length L2 of the roller 300, e.g., between 85% and 99%, 90% and 99%, etc., of the length L2 of the roller 300.

Referring to FIG. 4B, a length L8 of one of the elongate portions 305*a*, 305*b* of the support structure 303 is, for example, between 1 cm and 5 cm, e.g., between 1 and 3 cm, 2 and 4 cm, 3 and 5 cm, etc. The elongate portions 305*a*, 306*b* have a combined length that is, for example, between 10 and 30% of an overall length L9 of the support structure 303, e.g., between 10% and 20%, 15% and 25%, 20% and 30%, etc., of the overall length L9. In some examples, the length of the elongate portion 305*a* differs from the length of the elongate portion 305*b*. The length of the elongate portion 305*a* is, for example, 50% to 90%, e.g., 50% to 70%, 70% to 90%, the length of the elongate portion 305*b*.

The length L3 of the core 304 is, for example, between 70% and 90% of the overall length L9, e.g., between 70% and 80%, 75% and 85%, 80% and 90%, etc., of the overall length L9. The overall length L9 is, for example, between 85% and 99% of the overall length L2 of the roller 300, e.g., between 90% and 99%, 95% and 99%, etc., of the overall length L2 of the roller 300. The shaft 306 extends beyond the elongate portion 305*a* by a length L10 of, for example, 0.3 mm to 2 mm, e.g., between 0.3 mm and 1 mm, 0.3 mm and 1.5 mm, etc. As described herein, in some cases, the overall length L2 of the roller 300 corresponds to the overall length of the shaft 306, which extends beyond the length L9 of the support structure 303.

Referring to FIG. 3E, in some implementations, a length L5 of one of the collection wells 328, 330 is, for example, between 1.5 cm and 10 cm, e.g., between 1.5 cm and 7.5 cm, 5 cm and 10 cm, etc. The length L5, for example, corresponds to the length of the cylindrical portions 343*a*, 343*b* of the shell 336 and the length of the free portions 331*b*, 331*c* of the sheath 302. The length L5 of one of the collection wells 328, 330 is, for example, 2.5% to 15% of the length L2 of the roller 300, e.g., between 2.5% and 10%, 5% and 10%, 7.5% and 12.5%, 10% and 15% of the length L2 of the roller 300. An overall combined length of the collection wells 328, 330 is, for example, between 3 cm and 15 cm, e.g., between 3 and 10 cm, 10 and 15 cm, etc. This overall combined length corresponds to an overall combined length of the free portions 331*b*, 331*c* of the sheath 302 and an overall combined length of the cylindrical portions 343*a*, 343*b* of the shell 336. The overall combined length of the collection wells 328, 330 is, for example, between 5% and 30% of the length L2 of the roller 300, e.g., between 5% and 15%, 5% and 20%, 10% and 25%, 15% and 30%, etc., of the length L2 of the roller 300. In some examples, the combined length of the collection wells 328, 330 is between 5% and 40% of the length L3 of the core 304, e.g., between 5% and 20%, 20% and 30%, and 30% and 40%, etc. of the length L3 of the core 304.

In some implementations, as shown in FIG. 6, a width or diameter of the roller 300 between the end portion 318 and the end portion 320 of the sheath 302 corresponds to the diameter D7 of the sheath 302. The diameter D7 is, in some cases, uniform from the end portion 318 to the end portion 320 of the sheath 302. The diameter D7 of the roller 300 at different positions along the longitudinal axis 312 of the roller 300 between the position of the end portion 318 and the position of the end portion 320 is equal. The diameter D7 is between, for example, 20 mm and 60 mm, e.g., between 20 mm and 40 mm, 30 mm and 50 mm, 40 mm and 60 mm, etc.

Referring to FIG. 5B, the height H1 of the vane 342 is, for example, between 0.5 mm and 25 mm, e.g., between 0.5 and 2 mm, 5 and 15 mm, 5 and 20 mm, 5 and 25 mm, etc. The height H1 of the vane 342 at the central plane 327 is between, for example, 2.5 and 25 mm, e.g., between 2.5 and 12.5 mm, 7.5 and 17.5 mm, 12.5 and 25 mm, etc. The height H1 of the vane 342 at the end portions 318, 320 of the sheath 302 is between, for example, 0.5 and 5 mm, e.g., between 0.5 and 1.5 mm, 0.5 and 2.5 mm, etc. The height H1 of the vane 342 at the central plane 327 is, for example, 1.5 to 50 times greater than the height H1 of the vane 342 at the end portions 318, 320 of the sheath 302, e.g., 1.5 to 5, 5 to 10, 10 to 20, 10 to 50, etc., times greater than the height H1 of the vane 342 at the end portions 318, 320. The height H1 of the vane 342 at the central plane 327, for example, corresponds to the maximum height of the vane 342, and the height H1 of the vane 342 at the end portions 318, 320 of the sheath 302 corresponds to the minimum height of the vane 342. In some implementations, the maximum height of the vane 342 is 5% to 45% of the diameter D7 of the sheath 302, e.g., 5% to 15%, 15% to 30%, 30% to 45%, etc., of the diameter D7 of the sheath 302.

While the diameter D7 may be uniform between the end portions 318, 320 of the sheath 302, the diameter of the core 304 may vary at different points along the length of the roller 300. The diameter D1 of the core 304 along the central plane 327 is between, for example, 5 mm and 20 mm, e.g., between 5 and 10 mm, 10 and 15 mm, 15 and 20 mm etc. The diameters D2, D3 of the core 304 near or at the first and second end portions 314, 316 of the core 304 is between, for example, 10 mm and 50 mm, e.g., between 10 and 20 mm, 15 and 25 mm, 20 and 30 mm, 20 and 50 mm. The diameters D2, D3 are, for example the maximum diameters of the core 304, while the diameter D1 is the minimum diameter of the core 304. The diameters D2, D3 are, for example, 5 to 20 mm less than the diameter D7 of the sheath 302, e.g., 5 to 10 mm, 5 to 15 mm, 10 to 20 mm, etc., less than the diameter D7. In some implementations, the diameters D2, D3 are 10% to 90% of the diameter D7 of the sheath 302, e.g., 10% to 30%, 30% to 60%, 60% to 90%, etc., of the diameter D7 of the sheath 302. The diameter D1 is, for example, 10 to 25 mm less than the diameter D7 of the sheath 302, e.g., between 10 and 15 mm, 10 and 20 mm, 15 and 25 mm, etc., less than the diameter D7 of the sheath 302. In some implementations, the diameter D1 is 5% to 80% of the diameter D7 of the sheath 302, e.g., 5% to 30%, 30% to 55%, 55% to 80%, etc., of the diameter D7 of the sheath 302.

Similarly, while the outer diameter of the sheath 302 defined by the free ends 502*a*, 502*b* of the vanes 342*a*, 342*b* may be uniform, the diameter of the shell 336 of the sheath 302 may vary at different points along the length of the shell 336. The diameter D4 of the shell 336 along the central plane 327 is between, for example, 7 mm and 22 mm, e.g., between 7 and 17 mm, 12 and 22 mm, etc. The diameter D4 of the shell 336 along the central plane 327 is, for example, defined by a wall thickness of the shell 336. The diameters D5, D6 of the shell 336 at the outer end portions 318, 320 of the sheath 302 are, for example, between 15 mm and 55 mm, e.g., between 15 and 40 mm, 20 and 45 mm, 30 mm and 55 mm, etc. In some cases, the diameters D4, D5, and D6 are 1 to 5 mm greater than the diameters D1, D2, and D3 of the core 304 along the central plane 327, e.g., between 1 and 3 mm, 2 and 4 mm, 3 and 5 mm, etc., greater than the diameter D1. The diameter D4 of the shell 336 is, for example, between 10% and 50% of the diameter D7 of the sheath 302, e.g., between 10% and 20%, 15% and 25%, 30% and 50%, etc., of the diameter D7. The diameters D5, D6 of the shell 336 is, for example, between 80% and 95% of the diameter D7 of the sheath 302, e.g., between 80% and 90%, 85% and 95%, 90% and 95%, etc., of the diameter D7 of the sheath 302.

In some implementations, the diameter D4 corresponds to the minimum diameter of the shell 336 along the length of the shell 336, and the diameters D5, D6 correspond to the maximum diameter of the shell 336 along the length of the shell 336. The diameters D5, D6 correspond to, for example, the diameters of the cylindrical portions 343*a*, 343*b* of the shell 336 and the maximum diameters of the frustroconical portions 341*a*, 341*b* of the shell 336. In the example depicted in FIG. 1A, the length S2 of the separation 108 is defined by the maximum diameters of the shells of the cleaning rollers 104*a*, 104*b*. The length S3 of the separation S3 of the separation 108 is defined by the minimum diameters of the shells of the cleaning rollers 104*a*, 104*b*.

In some implementations, the diameter of the core 304 varies linearly along the length of the core 304. From the minimum diameter to the maximum diameter over the length of the core 304, the diameter of the core 304 increases with a slope M1 between, for example, 0.01 to 0.4 mm/mm, e.g., between 0.01 to 0.3 mm/mm, 0.05 mm to 0.35 mm/mm, etc. In this regard, the angle between the slope M1 defined by the outer surface of the core 304 and the longitudinal axis 312 is between, for example, 0.5 degrees and 20 degrees, e.g., between 1 and 10 degrees, 5 and 20 degrees, 5 and 15 degrees, 10 and 20 degrees, etc.

Referring to FIG. 3E, similarly, the diameter of the shell 336 also varies linearly along the length of the shell 336 in some examples. From the minimum diameter to the maximum diameter along the length of the shell 336, the diameter of the core 304 increases with a slope M2 similar to the slope described with respect to the diameter of the core 304. The slope M2 is between, for example, 0.01 to 0.4 mm/mm, e.g., between 0.01 to 0.3 mm/mm, 0.05 mm to 0.35 mm/mm, etc. The angle between the slope M2 defined by the outer surface of the shell 336 and the longitudinal axis is similar to the slope M1 of the core 304. The angle between the slope M2 and the longitudinal axis 312 is between, for example, 0.5 degrees and 20 degrees, e.g., between 1 and 10 degrees, 5 and 20 degrees, 5 and 15 degrees, 10 and 20 degrees, etc. In particular, the slope M2 corresponds to the slope of the frustoconical portions 341*a*, 341*b* of the shell 336.

Example Fabrication Processes for Cleaning Rollers

The specific configurations of the sheath 302, the support structure 303, and the shaft 306 of the roller 300 can be fabricated using one of a number of appropriate processes. The shaft 306 is, for example, a monolithic component formed from a metal fabrication process, such as machining, metal injection molding, etc. To affix the support structure 303 to the shaft 306, the support structure 303 is formed from, for example, a plastic material in an injection molding process in which molten plastic material is injected into a mold for the support structure 303. In some implementations, in an insert injection molding process, the shaft 306 is inserted into the mold for the support structure 303 before the molten plastic material is injected into the mold. The molten plastic material, upon cooling, bonds with the shaft 306 and forms the support structure 303 within the mold. As a result, the support structure 303 is affixed to the shaft 306. If the core 304 of the support structure 303 includes the discontinuous sections 402*a*, 402*b*, 402*c*, 404*a*, 404*b*, 404*c*, the surfaces of the mold engages the shaft 306 at the gaps 403 between the discontinuous sections 402*a*, 402*b*, 402*c*, 404*a*, 404*b*, 404*c* to inhibit the support structure 303 from forming at the gaps 403.

In some cases, the sheath 302 is formed from an insert injection molding process in which the shaft 306 with the support structure 303 affixed to the shaft 306 is inserted into a mold for the sheath 302 before molten plastic material forming the sheath 302 is injected into the mold. The molten plastic material, upon cooling, bonds with the core 304 of the support structure 303 and forms the sheath 302 within the mold. By bonding with the core 304 during the injection molding process, the sheath 302 is affixed to the support structure 303 through the core 304. In some implementations, the mold for the sheath 302 is designed so that the frustoconical portions 341*a*, 341*b* are bonded to the core 304, while the cylindrical portions 343*a*, 343*b* are not bonded to the core 304. Rather, the cylindrical portions 343*a*, 343*b* are unattached and extend freely beyond the end portions 314, 316 of the core 304 to define the collection wells 328, 330.

In some implementations, to improve bond strength between the sheath 302 and the core 304, the core 304 includes structural features that increase a bonding area between the sheath 302 and the core 304 when the molten plastic material for the sheath 302 cools. In some implementations, the lobes of the core 304, e.g., the lobes 414*a*-414*d*, 418*a*-418*d*, increase the bonding area between the sheath 302 and the core 304. The core securing portion 350 and the lobes of the core 304 have increased bonding area compared to other examples in which the core 304 has, for example, a uniform cylindrical or uniform prismatic shape. In a further example, the posts 420 extend into sheath 302, thereby further increasing the bonding area between the core securing portion 350 and the sheath 302. The posts 420 engage the sheath 302 to rotationally couple the sheath 302 to the core 304. In some implementations, the gaps 403 between the discontinuous sections 402*a*, 402*b*, 402*c*, 404*a*, 404*b*, 404*c* enable the plastic material forming the sheath 302 extend radially inwardly toward the shaft 306 such that a portion of the sheath 302 is positioned between the discontinuous sections 402*a*, 402*b*, 402*c*, 404*a*, 404*b*, 404*c* within the gaps 403. In some cases, the shaft securing portion 352 contacts the shaft 306 and is directly bonded to the shaft 306 during the insert molding process described herein.

This example fabrication process can further facilitate even torque transfer from the shaft 306, to the support structure 303, and to the sheath 302. The enhanced bonding between these structures can reduce the likelihood that torque does not get transferred from the drive axis, e.g., the longitudinal axis 312 of the roller 300 outward toward the outer surface of the sheath 302. Because torque is efficiently transferred to the outer surface, debris pickup can be enhanced because a greater portion of the outer surface of the roller 300 exerts a greater amount of torque to move debris on the floor surface.

Furthermore, because the sheath 302 extends inwardly toward the core 304 and interlocks with the core 304, the shell 336 of the sheath 302 can maintain a round shape in response to contact with the floor surface. While the vanes 342*a*, 342*b* can deflect in response to contact with the floor surface and/or contact with debris, the shell 336 can deflect relatively less, thereby enabling the shell 336 to apply a greater amount of force to debris that it contacts. This increased force applied to the debris can increase the amount of agitation of the debris such that the roller 300 can more easily ingest the debris. Furthermore, increased agitation of the debris can assist the airflow 120 generated by the vacuum assembly 118 to carry the debris into the cleaning robot 102. In this regard, rather than deflecting in response to contact with the floor surface, the roller 300 can retains its shape and more easily transfer force to the debris.

Alternative Implementations

A number of implementations have been described. Nevertheless, it will be understood that various modifications may be made.

While some of the foregoing examples are described with respect to a single roller 300 or the roller 104*a*, the roller 300 is similar to the front roller 104*b* with the exception that the arrangement of vanes 342 of the roller 300 differ from the arrangement of the vanes 224*b* of the front roller 104*b*, as described herein. In particular, because the roller 104*b* is a front roller and the roller 104*a* is a rear roller, the V-shaped path for a vane 224*a* of the roller 104*a* is symmetric to the V-shaped path for a vane 224*b* of the roller 104*b*, e.g., about a vertical plane equidistant to the longitudinal axes 126*a*, 126*b* of the rollers 104*a*, 104*b*. The legs for the V-shaped path for the vane 224*b* extend in the counterclockwise direction 130*b* along the outer surface of the shell 222*b* of the roller 104*b*, while the legs for the V-shaped path for the vane 224*a* extend in the clockwise direction 130*a* along the outer surface of the shell 222*a* of the roller 104*a*.

In some implementations, the roller 104*a* and the roller 104*b* have different lengths. The roller 104*b* is, for example, shorter than the roller 104*a*. The length of the roller 104*b* is, for example, 50% to 90% the length of the roller 104*a*, e.g., 50% to 70%, 60% to 80%, 70% to 90% of the length of the roller 104*a*. If the lengths of the rollers 104*a*, 104*b* are different, the rollers 104*a*, 104*b* are, in some cases, configured such that the minimum diameter of the shells 222*a*, 222*b* of the rollers 104*a*, 104*b* are along the same plane perpendicular to both the longitudinal axes 126*a*, 126*b* of the rollers 104*a*, 104*b*. As a result, the separation between the shells 222*a*, 222*b* is defined by the shells 222*a*, 222*b* at this plane.

Accordingly, other implementations are within the scope of the claims.

What is claimed is:

1. An autonomous cleaning robot comprising:

a body;

a drive operable to move the body across a floor surface;

a first cleaning roller mounted to the body and rotatable about a first axis; and a second cleaning roller mounted to the body and rotatable about a second axis parallel to the first axis, wherein an outer surface of the first cleaning roller and an outer surface of the second cleaning roller define a separation between the outer surface of the first cleaning roller and the outer surface of the second cleaning roller, the separation extending along the first axis and increasing towards a center of a length of the first cleaning roller, and wherein the first cleaning roller comprises a vane extending radially outwardly from the outer surface of the first cleaning roller.

2. The autonomous cleaning robot of claim 1, wherein the separation increases linearly toward the center of the length of the first cleaning roller.

3. The autonomous cleaning robot of claim 1, wherein the separation is between 5 and 30 millimeters at the center of the length of the first cleaning roller.

4. The autonomous cleaning robot of claim 1, wherein the length of the first cleaning roller is between 20 and 30 centimeters.

5. The autonomous cleaning robot of claim 1, wherein a forward portion of the body has a substantially rectangular shape, and the first and second cleaning rollers are mounted to an underside of the forward portion of the body.

6. The autonomous cleaning robot of claim 1, further comprising:

a vacuum assembly operable to generate an airflow through the separation to facilitate ingestion of debris from the floor surface; and a cleaning bin to receive the debris ingested from the floor surface.

7. The autonomous cleaning robot of claim 1, further comprising:

one or more actuators to drive the first cleaning roller and the second cleaning roller, and a controller to operate the one or more actuators to rotate the first cleaning roller in a first direction and the second cleaning roller in a second direction opposite the first direction during a cleaning operation to facilitate ingestion of debris from the floor surface.

8. The autonomous cleaning robot of claim 7, wherein the first cleaning roller comprises a sheath defining the outer surface of the first cleaning roller, the sheath defining collection wells to store a portion of the debris.

9. The autonomous cleaning robot of claim 1, wherein a height of the vane proximate to a first end portion of the first cleaning roller is less than the height of the vane proximate to the center of the length of the first cleaning roller.

10. The autonomous cleaning robot of claim 9, wherein the height of the vane proximate to the first end portion of the first cleaning roller is between 1 and 5 millimeters, and the height of the vane proximate to the center of the length of the first cleaning roller is between 10 and 30 millimeters.

11. The autonomous cleaning robot of claim 9, wherein the height of the vane proximate to the first end portion of the first cleaning roller is 5% to 45% of the height of the vane proximate to the center of the length of the first cleaning roller.

12. The autonomous cleaning robot of claim 1, wherein the separation is constant during a rotation of the first cleaning roller about the first axis relative to the body.

13. The autonomous cleaning robot of claim 12, wherein the second cleaning roller comprises a vane extending radially outwardly from the outer surface of the second cleaning roller.

14. The autonomous cleaning robot of claim 13, wherein the vane of the first cleaning roller and the vane of the second cleaning define an air gap between the vane of the first cleaning roller and the vane of the second cleaning roller, wherein the air gap varies during the rotation of the first cleaning roller about the first axis relative to the body.

15. A cleaning assembly for an autonomous cleaning robot, the cleaning assembly comprising:

a first cleaning roller mountable to the autonomous cleaning robot along a first axis, the first cleaning roller being rotatable about the first axis when mounted to the autonomous cleaning robot; and a second cleaning roller mountable to the autonomous cleaning robot along a second axis parallel to the first axis, the second cleaning roller being rotatable about the second axis when mounted to the autonomous cleaning robot, wherein an outer surface of the first cleaning roller and an outer surface of the second cleaning roller define a separation between the outer surface of the first cleaning roller and the outer surface of the second cleaning roller, the separation extending along the first axis and increasing towards a center of a length of the first cleaning roller, and wherein the first cleaning roller comprises a vane extending radially outwardly from the outer surface of the first cleaning roller.

16. The cleaning assembly of claim 15, wherein the separation increases linearly toward the center of the length of the first cleaning roller.

17. The cleaning assembly of claim 15, wherein the separation is between 5 and 30 millimeters at the center of the length of the first cleaning roller.

18. The cleaning assembly of claim 15, wherein the length of the first cleaning roller is between 20 and 30 centimeters.

19. The cleaning assembly of claim 15, wherein the first cleaning roller comprises a sheath defining the outer surface of the first cleaning roller, the sheath defining collection wells to receive a portion of debris collected by the autonomous cleaning robot.

20. The cleaning assembly of claim 15, wherein a height of the vane proximate to a first end portion of the first cleaning roller is less than the height of the vane proximate to the center of the length of the first cleaning roller.

21. The cleaning assembly of claim 20, wherein the height of the vane proximate to the first end portion of the first cleaning roller is between 1 and 5 millimeters, and the height of the vane proximate to the center of the length of the first cleaning roller is between 10 and 30 millimeters.

22. The cleaning assembly of claim 20, wherein the height of the vane proximate to the first end portion of the first cleaning roller is 5% to 45% of the height of the vane proximate to the center of the length of the first cleaning roller.

* * * * *